US009500009B2

(12) United States Patent
Sayegh et al.

(10) Patent No.: US 9,500,009 B2
(45) Date of Patent: Nov. 22, 2016

(54) THEFT-DETERRENT TAG

(75) Inventors: Adel O. Sayegh, Rancho Cucamonga, CA (US); Edgardo Redublo, Chino Hills, CA (US); Zhaolian Wu, Hangzhou (CN); Weiliang Tong, Hangzhou (CN)

(73) Assignee: Universal Surveillance Corporation, Rancho Cucamonga, CA (US)

( * ) Notice: Subject to any disclaimer, the term of this patent is extended or adjusted under 35 U.S.C. 154(b) by 276 days.

(21) Appl. No.: 13/437,822

(22) Filed: Apr. 2, 2012

(65) Prior Publication Data

US 2013/0255332 A1 Oct. 3, 2013

(51) Int. Cl.
*G08B 13/14* (2006.01)
*E05B 73/00* (2006.01)

(52) U.S. Cl.
CPC ..... *E05B 73/0029* (2013.01); *E05B 73/0094* (2013.01); *Y10T 29/49826* (2015.01); *Y10T 70/40* (2015.04); *Y10T 70/402* (2015.04)

(58) Field of Classification Search
CPC ..... E05B 73/0017; E05B 73/0029; E05B 73/0041; E05B 73/0094; G08B 13/2402; G08B 13/2428; G08B 13/2434; G06K 19/07749; G06K 19/07758; G06K 19/0723; G06K 2017/0045
USPC ..... 340/572.1, 572.8, 572.9
See application file for complete search history.

(56) References Cited

U.S. PATENT DOCUMENTS

| | | | | |
|---|---|---|---|---|
| 2006/0137411 | A1* | 6/2006 | Fawcett et al. | 70/57.1 |
| 2007/0012772 | A1* | 1/2007 | Cooper | 340/572.8 |
| 2008/0303670 | A1* | 12/2008 | Seidel | 340/572.1 |
| 2009/0223260 | A1* | 9/2009 | Conti et al. | 340/572.9 |
| 2010/0032476 | A1* | 2/2010 | Mockli | 340/10.1 |

* cited by examiner

*Primary Examiner* — Thomas Mullen
(74) *Attorney, Agent, or Firm* — Milord A. Keshishian

(57) ABSTRACT

An Electronic Article Surveillance (EAS) tag that has a main member coupled with an article and an adjustable piece that is looped around the article and manipulated for a tight engagement of the main member with the article for securing the article.

31 Claims, 21 Drawing Sheets

THEFT-DETERRENT TAG

BACKGROUND OF THE INVENTION

Field of the Invention

This invention relates to theft deterrent security tags in general, and in particular to Electronic Article Surveillance (EAS) security tags that are coupled with articles without altering or damaging the article.

Description of Related Art

It is a common practice for retail stores to tag articles to prevent theft of the article by shoplifters. There are several methods of tagging articles, most common of which are coupling an EAS tag or markers (e.g., EAS labels) using adhesive, pins, lanyards or straps to trigger the EAS security system resulting in an alarm. The label markers are easy to remove while the cables or strapped tags are sometimes bulky or obtrusive to the person handling the article, making product placement of the article inconvenient and marketing thereof ineffective. As to pin type EAS tags, they are coupled with an article by the pin of the EAS tag puncturing the article, which may not be possible with most articles, such as skateboards, snowboards, pricey framed art, etc.

Accordingly, there remains a long standing and continuing need for an advance in the art of EAS and theft deterrent tags that makes the tags more difficult to defeat, simpler in both design and use, more economical and efficient in their construction and use, and provide a more secure and reliable engagement of the article to be monitored without damaging or altering the article.

BRIEF SUMMARY OF THE INVENTION

A non-limiting, exemplary aspect of the present invention provides a theft-deterrent tag, comprising:

a main member coupled with an article and an adjustable piece that is looped around the article and manipulated for a tight engagement of the main member with the article.

A non-limiting, exemplary optional aspect of the present invention provides a theft-deterrent tag, wherein:

the main member defines a main gap for securing a portion of the article therein, while the adjustable piece is looped and wrapped around the article.

Another non-limiting, exemplary optional aspect of the present invention provides a theft-deterrent tag, wherein:

the main gap is defined by:

a main first part that contacts a first article side of the portion of the article;

a main second part that contacts a second article side of the portion of the article; and a main third part that connects the first and the second parts and contacts a third article side of the portion of the article.

Still another non-limiting, exemplary optional aspect of the present invention provides a theft-deterrent tag, wherein:

the main first, second, and third parts defining the main gap form the main member.

Yet another non-limiting, exemplary optional aspect of the present invention provides a theft-deterrent tag, wherein:

the main first part of the main member accommodates a reel mechanism;

the main second part of the main member accommodates a power source and electronics of an Electronic Article Surveillance (EAS) system;

the main third part of the main member accommodates an alarm switch that actuates upon securing the article within the gap.

A further non-limiting, exemplary optional aspect of the present invention provides a theft-deterrent tag, wherein:

the alarm switch is actuated when a side of the article is pressed against the alarm switch, and the theft-deterrent tag is tightly secured on the article.

Still a further non-limiting, exemplary optional aspect of the present invention provides a theft-deterrent tag, wherein:

the adjustable piece is comprised of a multi-wire lanyard having:

a first end and a second end coupled with the respective main first and second parts of the main member, and a lanyard body that forms a loop.

Yet a further non-limiting, exemplary optional aspect of the present invention provides a theft-deterrent tag, wherein:

the first end of the lanyard extends out of the main first part of the main member with the body of the lanyard looped and entering into the main second part of the main member, with the second end of the lanyard coupled with the main second part of the main member.

Another non-limiting, exemplary optional aspect of the present invention provides a theft-deterrent tag, wherein:

the first end of the lanyard is coupled with the reel mechanism;

the second end of the lanyard is coupled with the housed electronics; and the lanyard body is looped and lassoed around the article.

Still another non-limiting, exemplary optional aspect of the present invention provides a theft-deterrent tag, wherein:

the main member is tightly secured with the article when the adjustable piece is contracted.

Yet another non-limiting, exemplary optional aspect of the present invention provides a theft-deterrent tag, wherein:

the main first, second, and third parts of the main member are movably adjustable in relation to one another for varying a size of the main gap.

A non-limiting, exemplary aspect of the present invention provides a theft-deterrent tag, comprising:

a first member coupled with a first article portion of an article and a second member coupled with a second article portion of the article, with the first member associated with the second member by an adjustable piece.

Another non-limiting, exemplary optional aspect of the present invention provides a theft-deterrent tag, wherein:

the first article portion is positioned at a different location of the article from the second article portion.

Still another non-limiting, exemplary optional aspect of the present invention provides a theft-deterrent tag, wherein:

the first member, the second member, and the adjustable piece are separate and independent, forming separate and independent elements.

Yet another non-limiting, exemplary optional aspect of the present invention provides a theft-deterrent tag, wherein:

the first member defines a first gap for securing the first article portion therein, and the second member defines a second gap for securing the second article portion therein, with the adjustable piece manipulated for a tight engagement of the first and second members with the article.

A further non-limiting, exemplary optional aspect of the present invention provides a theft-deterrent tag, wherein:

the first and the second gaps are defined by:

a first part that contact a first article side of the respective first article portion and the second article portion;

a second part that contact a second article side of the respective first article portion and the second article portion; and a third part that connect the first and the second parts and contacts a third article side of the respective first article portion and the second article portion.

Still a further non-limiting, exemplary optional aspect of the present invention provides a theft-deterrent tag, wherein:

the first, second, and third part defining the respective first and second gaps form the respective first member and second member.

Yet a further non-limiting, exemplary optional aspect of the present invention provides a theft-deterrent tag, wherein:

the first part of the first member accommodates a reel mechanism the second part of the first member accommodates a power source and electronics of the EAS tag;

the third part of the first member accommodates an alarm switch that actuates upon securing the article within the first gap.

Another non-limiting, exemplary optional aspect of the present invention provides a theft-deterrent tag, wherein:

the alarm switch is actuated when a side of the article is pressed against the alarm switch, and the theft-deterrent tag is tightly secured on the article.

Still another non-limiting, exemplary optional aspect of the present invention provides a theft-deterrent tag, wherein:

the first, second, and third part of the second member accommodate to guide the adjustable piece looped back towards the first member.

Yet another non-limiting, exemplary optional aspect of the present invention provides a theft-deterrent tag, wherein:

the adjustable piece is comprised of a multi-wire lanyard having:

a first end and a second end coupled with the respective first and second parts of the first member, and a lanyard body that loops through the second member.

A further non-limiting, exemplary optional aspect of the present invention provides a theft-deterrent tag, wherein:

the first end of the lanyard extends out of the first part of the first member with the body of the lanyard entering a first part of the second member, looping through the second member and existing a second part of the second member and into the second part of the first member, with the second end of the lanyard coupled with the second part of the first member.

Still a further non-limiting, exemplary optional aspect of the present invention provides a theft-deterrent tag, wherein:

the first end of the lanyard is coupled with a reel mechanism;

the second end of the lanyard is coupled with the housed electronics; and the lanyard body is accommodated by the second member, and is looped there through over a roller mechanism to facilitate ease of adjustability of the adjustable piece to one of an extended and contracted positions.

Yet a further non-limiting, exemplary optional aspect of the present invention provides a theft-deterrent tag, wherein:

the first and second members may be maneuvered to opposite directions when the adjustable piece is extended, and the first and second members are maneuvered towards each other when the adjustable piece is contracted.

Another non-limiting, exemplary optional aspect of the present invention provides a theft-deterrent tag, wherein:

the second member is comprised of:

a first opening in a top front area of a first part of the second member;

a second opening in a bottom front area of a second part of the second member;

an interior of the second member includes:

a cavity that enables free maneuverability of the adjustable piece; and a roller housing that accommodates a roller.

Yet another non-limiting, exemplary optional aspect of the present invention provides a theft-deterrent tag, wherein:

a power switch is moved along a reciprocating path, transverse a longitudinal axis of the first member to actuate a power plunger switch to enable supply of power to an internal alarm system of the theft-deterrent tag;

the power switch is biased, extending out of a lateral rear side of the first member when in open position by a biasing mechanism, includes clutch interlock aperture for detachably interlocking with a clutch when in closed position, and a beveled side that progressively engages for actuating an intermediate member along a reciprocating path along the longitudinal axis of the first member that is transverse the reciprocating path of the power switch to thereby release a plunger of the power plunger switch when the power switch reaches a closed position.

Still another non-limiting, exemplary optional aspect of the present invention provides a theft-deterrent tag, wherein:

the intermediate member further includes lateral flange that is extended substantially perpendicular an axial length of the intermediate member with flange surface that contacts a plunger of the power plunger switch at a first position, and a second end of the intermediate member is beveled and engages with the beveled side of the power switch.

A further non-limiting, exemplary optional aspect of the present invention provides a theft-deterrent tag, wherein:

the intermediate member actuates an interlocking member and a biasing scheme, both of which are accommodated by the intermediate member, with the interlocking member including beveled serrations at a first end thereof, which are oriented at a first direction that interlock with beveled serrations of a spool of a reel mechanism that are oriented at a second, opposite direction;

the spool, and the interlock member and biasing scheme form a ratchet and pawl mechanism, with the beveled serrations of the pawl forming a first set of sloped teeth, and the beveled serrations of the spool forming a second set of oppositely oriented sloped teeth;

whereby when the spool teeth are moving in a first direction, the pawl teeth slide up and over a gently sloped edges of the spool teeth, with biasing mechanism in a form of a spring forcing the pawl teeth into the depression between the spool teeth as the pawl teeth pass the tip of each spool tooth;

whereby when the spool teeth move in a second, opposite direction, the pawl teeth catch against steeply sloped edge of a first tooth of the spool teeth that the pawl teeth encounter, thereby locking the spool against the pawl tooth and preventing any further motion of the spool in the second direction.

Yet a further non-limiting, exemplary optional aspect of the present invention provides a theft-deterrent tag, wherein:

the reel mechanism is accommodated within a through-hole, transverse the longitudinal axis of the first part of the first member;

The reel mechanism is comprised of:

a revolving spool with a handle;

spool is comprised of a first flange, a second flange, and a spool body, with the first flange having a wider span than the second flange;

the first flange has a periphery that includes a wall that is serrated along an exterior facing side;

the spool body in between the first and second flange accommodates a majority portion of the adjusting piece, and includes an opening for insertion and interlocking of a first end of the adjustable piece at a substantial center of the spool body;

Another non-limiting, exemplary optional aspect of the present invention provides a theft-deterrent tag, wherein:

the alarm switch is comprised of substantially T configuration that includes:

a handle section and a head section;

a lower end of the handle section is comprised of a pivot arm that ends in a pivot aperture that accommodates a pivot shaft, enabling the alarm switch to pivot along a reciprocating path substantially parallel the longitudinal axis of the first member to one of actuated and non-actuated positions;

the head section includes:

an engaging portion that contacts with the article;

a rear beveled engaging portion that closes an alarm plunger switch when the alarm switch is actuated; and a biasing surface that couples the handle section and maintains the alarm switch to a non-actuated position by a contacting biasing mechanism.

Still another non-limiting, exemplary optional aspect of the present invention provides a theft-deterrent tag, wherein:

a clutch housing that accommodates a clutch is brought near magnet where the clutch is pulled out of a clutch interlock aperture, the power switch is pressed in slightly and then is released to an open position for powering OFF and deactivating the alarm.

Yet another non-limiting, exemplary optional aspect of the present invention provides a theft-deterrent tag, wherein:

the adjustable piece is two-wire lanyard forming a sense loop cable, having:

inner conductors enclosed within and inside outer conductors;

the inner conductors longitudinally insulated from one another and from the outer conductors by inner dielectric layers, with an outermost outer conductor of outer conductors longitudinally insulated by an outer dielectric layer;

a first distal end of the cable is comprised of short-circuited first end of the inner and outer conductors, and a second distal end of the cable is comprised of second end of the inner and outer conductors connected to respective ground (GND) and High, forming the sense loop cable;

wherein the shorted-circuited first end of the inner and outer conductors comprises electrical and mechanically connection of a first end of the inner and outer conductors;

wherein the second end of the inner and outer conductors comprises electrical and mechanically connection with a Printed Circuit Board (PCB).

Another non-limiting, exemplary optional aspect of the present invention provides a theft-deterrent tag, wherein:

at least one conductor is an internal spirally-wrapped electrical conductive cord for added mechanical strength for durability and bypass-prevention.

Another non-limiting, exemplary aspect of the present invention provides a method for securing an article with a theft deterrent tag, comprising:

inserting a first article portion of the article within a first gap of a first piece of the theft deterrent tag;

inserting a second article portion of the article within a second gap of a second piece of the theft deterrent tag;

manipulating the first and second pieces by an adjustable piece of the theft-deterrent tag for a tight engagement of the theft deterrent tag with the article, thereby actuating an alarm switch for setting an alarm system; and actuating a power switch to supply power to the alarm system of the theft deterrent tag.

Another non-limiting, exemplary optional aspect of the present invention provides a method for securing an article with a theft deterrent tag, wherein:

the alarm switch is actuated by the article when positioned and tightly secured within first and second gaps when the first and second pieces are maneuvered towards each other by the adjustable piece.

Another non-limiting, exemplary optional aspect of the present invention provides a method for securing an article with a theft deterrent tag, wherein:

the alarm switch is actuated by a side of the first article portion of the article.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

Figure 1A:
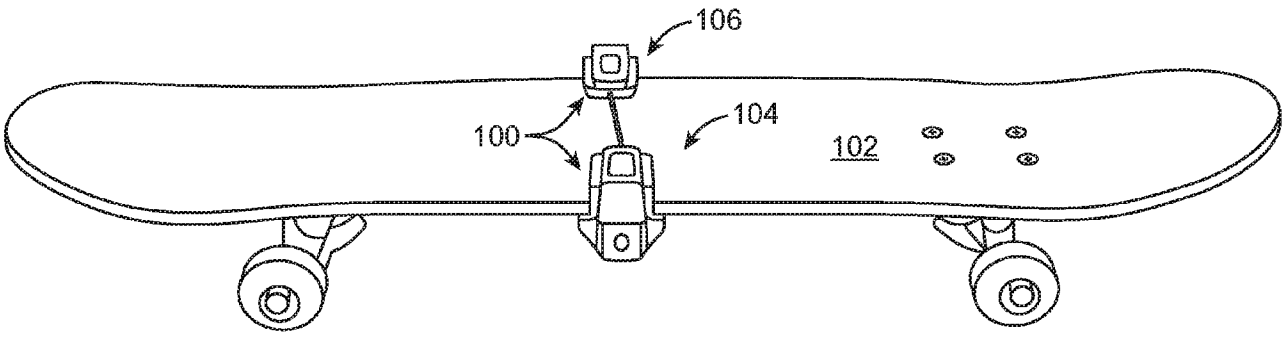
FIGS. 1A to 1D are non-limiting, exemplary illustrations of the Electronic Article Surveillance (EAS) theft-deterrent tag coupled with an article in accordance with the present invention.
Figure 1B:
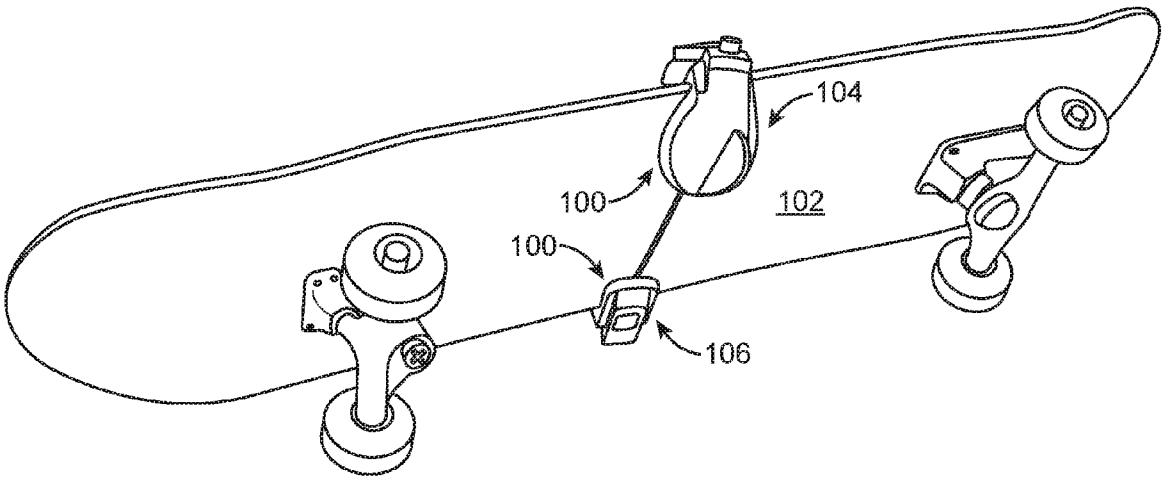
Figure 1C:
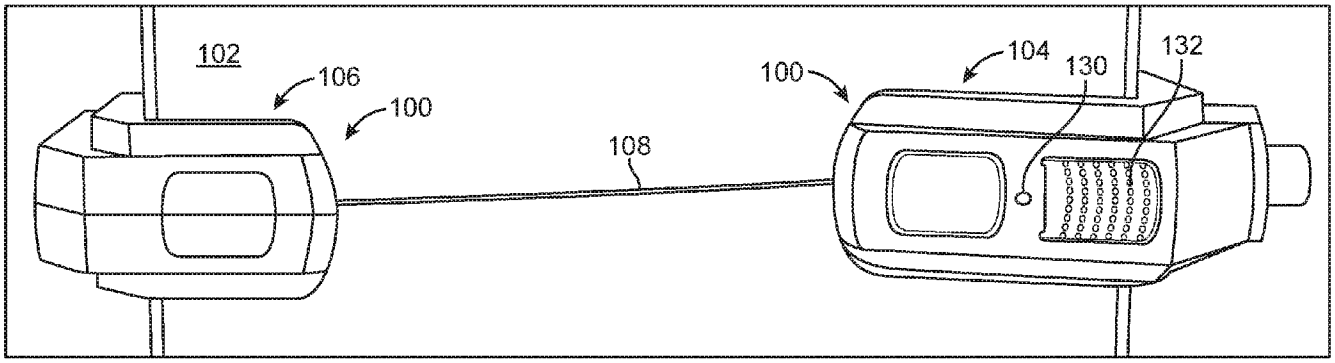
Figure 1D:
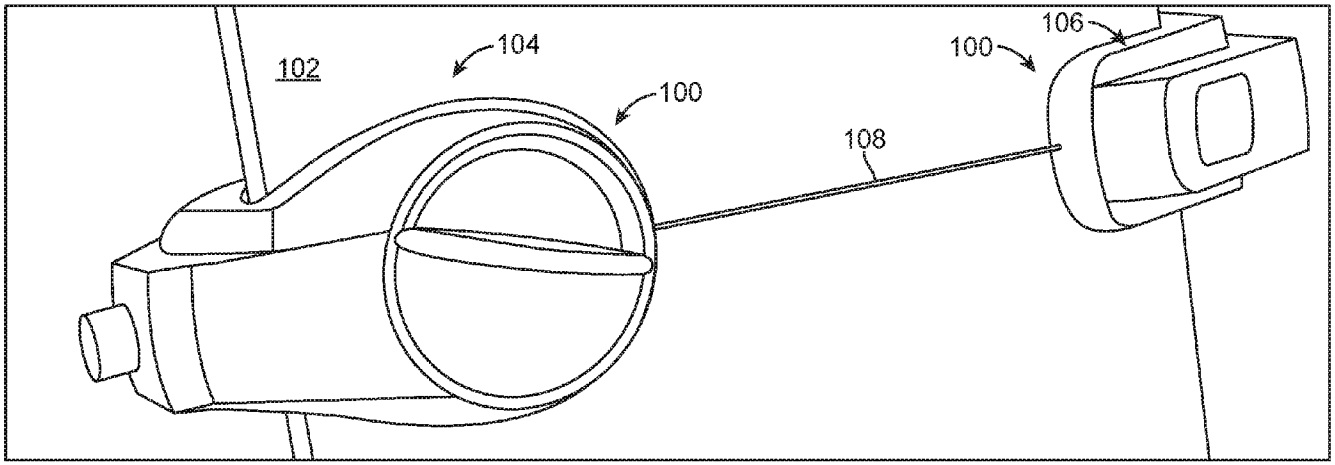

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. Further, each block within a flowchart may represent both method function(s), operation(s), or act(s) and one or more elements for performing the method function(s), operation(s), or act(s). In addition, depending upon the implementation, the corresponding one or more elements may be configured in hardware, software, firmware, or combinations thereof.

The present invention provides an Electronic Article Surveillance (EAS) theft deterrent tag that is more difficult to defeat, simpler in both design and use, more economical and efficient in construction and use, and provides a more secure and reliable engagement of the article to be monitored without damaging or altering the article. FIGS. 1A to 1D are non-limiting, exemplary illustrations of the EAS theft-deterrent tag 100 coupled with an article in accordance with the present invention. As illustrated in FIGS. 1A to 1D, the present invention provides an EAS theft deterrent tag 100 (hereinafter referred to as "EAS tag 100") comprised of a first (or main) member 104 that can be coupled with a first article portion of an article 102 and a second member 106 that can be coupled with a second article portion of the article 102, with the first (or main) member 104 associated with the second member 106 by an adjustable piece 108. The first (or main) member 104, the second member 106, and the adjustable piece 108 are separate and independent, forming separate and independent elements of the EAS tag 100 of the present invention. It should be noted that the EAS tag 100 may optionally comprise of only the first (or main) member 104 that may be coupled with the article 102 and the adjustable piece 108 that may be looped (or lassoed) around the article 102 and manipulated for a tight engagement of the main member 104 with the article. Accordingly, the second member 106 is optional.

Figure 1E:
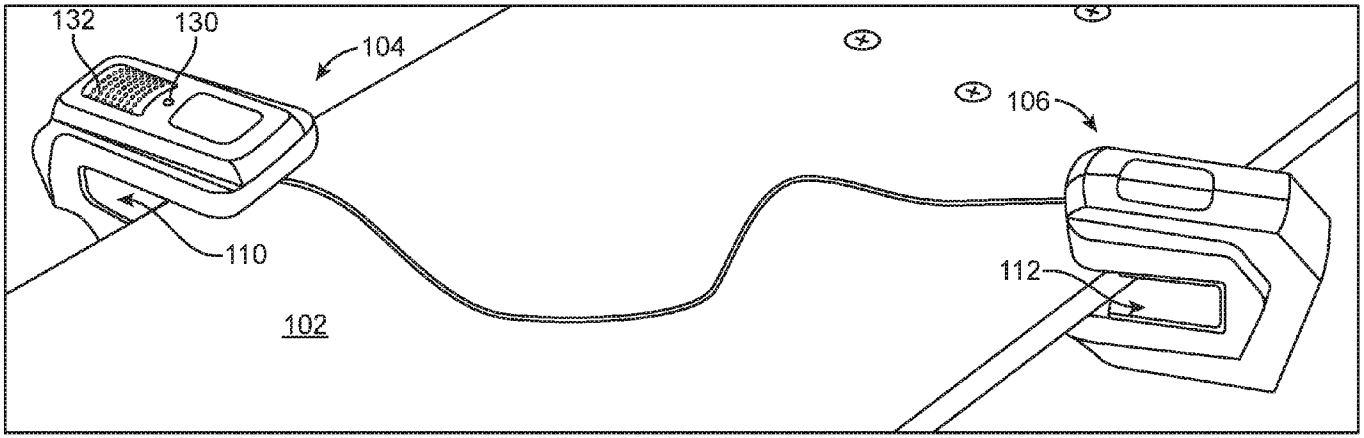
FIGS. 1E and 1F are non-limiting exemplary illustrations of the EAS theft-deterrent tag of FIGS. 1A to 1D in an uncoupled position in accordance with the present invention.
Figure 1F:
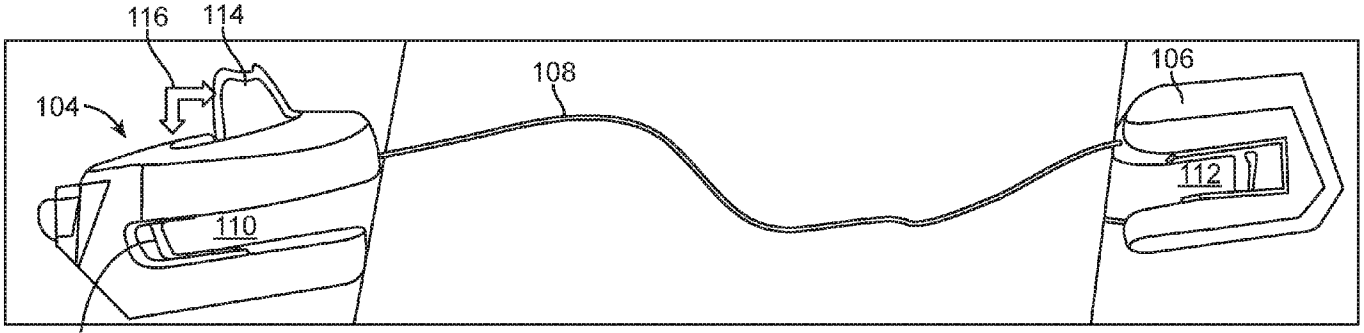

The EAS tag 100 may be coupled with any type of an article 102 without damaging (e.g., puncturing) or altering the article 102, non-limiting examples of which may include the illustrated skateboard, a snowboard, frames or a framed artwork, flat-screen displays, laptop computers, etc. FIGS. 1E and IF are non-limiting exemplary illustrations of the EAS tag 100 of FIGS. 1A to 1D in an uncoupled position in accordance with the present invention. As illustrated in FIGS. 1E and 1F, the main member 104 of the EAS tag 100 defines a main gap 110 for securing a portion of the article 102 therein, while the adjustable piece 108 is looped and wrapped around the article 102. More particularly, the first member 104 defines the first gap 110 for securing the first article portion therein, and the second member 106 defines a second gap 112 for securing the second article portion therein, with the adjustable piece 108 manipulated by a reel mechanism handle 114 for a tight engagement of the first and second members 104 and 106 with the article 102. The main member 104 accommodates an alarm switch 118 (also illustrated in FIG. 2B) that actuates upon securing the article 102 within the main gap 110, with the alarm switch 118 actuated when a side of the article 102 is pressed against the alarm switch 118 and the EAS tag 100 is tightly secured on the article 102 by the contraction (reeling-in) of the adjustable piece 108 by the reel mechanism (detailed below). After a tight mounting of the EAS tag 100 as illustrated in FIGS. 1A to 1D, the article 102 is protected by the EAS tag 100 upon actuation of a power switch 202 (FIG. 2A), which supplies power to an internal alarm system of the EAS tag 100 to arm the EAS tag 100. Accordingly, the first and second members 104 and 106 may be maneuvered to diagonally opposite directions when the adjustable piece 108 is extended, with the first and second members 104 and 106 maneuvered towards each other when the adjustable piece 108 is contracted to tightly couple the EAS tag 100 with the article 102.

Figure 2A:
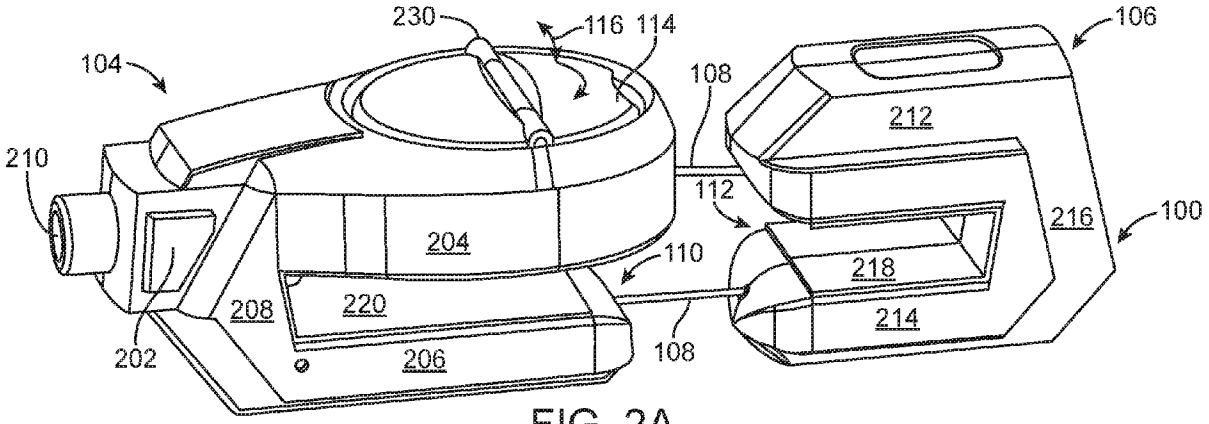
FIGS. 2A and 2B are non-limiting exemplary illustrations of the EAS theft-deterrent tag of FIGS. 1A to 1F, but without the illustrative article in accordance with the present invention.
Figure 2B:
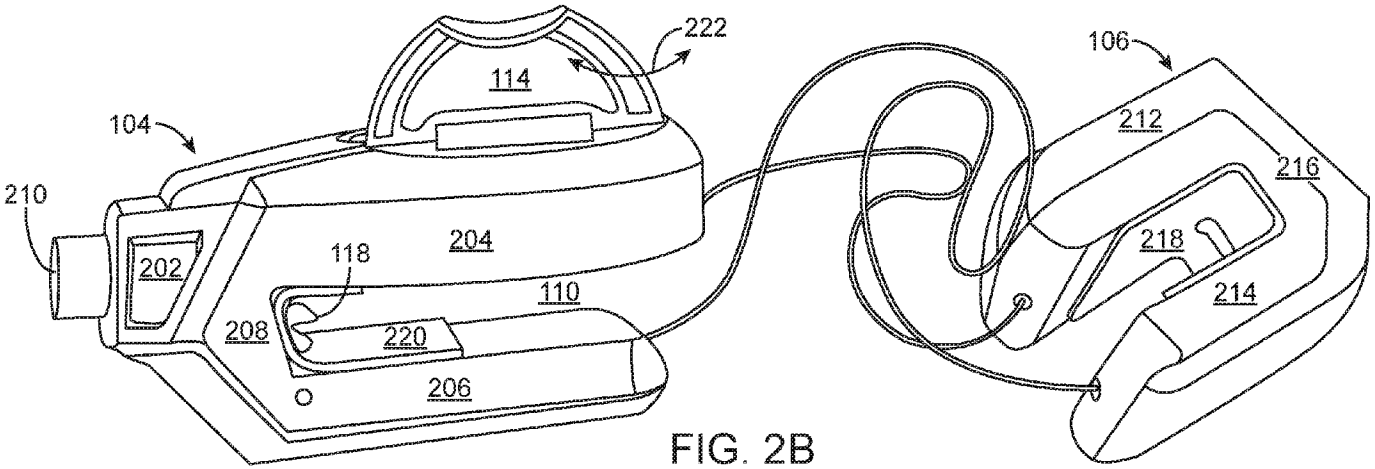

FIGS. 2A and 2B are exemplary illustrations of the EAS tag 100 of FIGS. 1A to 1F, but without the illustrative article in accordance with the present invention. As illustrated, the first or main member 104 of the EAS tag 100 of the present invention includes the first gap 110 that is defined by a main first part 204 that contacts a first article side of the first article portion, a main second part 206 that contacts a second article side of the first article portion, and a main third part 208 that connects the main first and the main second parts 204 and 206 together, and contacts a third article side of the first article portion. The main first, second, and third parts 204, 206, and 208 defining the first gap 110 form the first or main member 104. It should be noted that the main first, second, and third parts 204, 206, and 208 of the main member 104 may be movably adjustable in relation to one another for varying a size of the main gap 110 by hinge mechanisms or the like.

The main first part 204 of the main member 104 accommodates a reel mechanism (detailed below), including the reel handle 114 that when in the open position (FIG. 2B), may be used to rotate and turn the internally located reel mechanism inside the main first part 204 to extend or reel-in the adjustable piece 108. The reel handle 114 moves to the open position (FIG. 2B) along the indicated reciprocating path 116 by a hinge mechanism 230, and may be pivoted along the reciprocating path 222 to reel-in or extend the adjustable piece 108 to a desired length, and flipped back to a closed position (FIG. 2A) along the indicated path 116.

The main second part 206 of the main member 104 accommodates a power source and electronics of an Electronic Article Surveillance (EAS) system, with the main third part 208 of the main member 104 accommodating the alarm switch 118 that actuates upon securing the article 102 within the main gap 110. As stated above, the alarm switch 118 is actuated when a side of the article 102 is pressed against the alarm switch 118, and the EAS tag 100 is tightly secured on the article 102. The main member 104 further accommodates the power switch 202 that is normally biased to extend out of a lateral rear side of the main third part 208 of the first member 104 when in open (or OFF) position, with the power switch 202 enabling supply of power to the internal alarm system of the EAS tag 100. The rear of the main third part 208 of the main member 104 includes a clutch housing 210 that accommodates a clutch (details of which are provided below).

As further illustrated in FIGS. 2A and 2B, the optional second member 106 of the EAS tag 100 of the present invention includes the second gap 112 that is defined by a first part 212 that contacts a first article side of the second article portion, a second part 214 that contacts a second article side of the second article portion, and a third part 216 that connects the first and the second parts 212 and 214 together, and contacts a third article side of the second article portion. The first, second, and third parts 212, 214, and 216 defining the second gap 112 form the second member 106, which guides the adjustable piece 108 looped back towards the first member 104. It should be noted that the first, second, and third parts 212, 214, and 216 of the second member 106 may be movably adjustable in relation to one another for varying a size of the main gap 112 by hinge mechanisms or the like.

As further illustrated in FIGS. 2A and 2B, optionally, the gaps 110 and 112 may further include respective friction pads 220 and 218 that are coupled with the surfaces of the respective first, second, and third parts of the respective first member 104 and second member 106 that define the respective gaps 110 and 112. Accordingly, when tightly coupled with the article 102, the friction pads 220 and 218 of the EAS tag 100 will prevent the EAS tag 100 from sliding on a potentially smooth surface of an article 102, and will also prevent potential damage to article 102 (e.g., scratching the surface). More importantly, the friction pads 220 and 218 tightly grip the surface of the article 102, preventing the EAS tag 100 from being forcibly and intentionally maneuvered out and away from the article 102, thereby defeating the EAS tag 100. However, it should be noted that if the EAS tag 100 is somehow maneuvered out of position, the alarm switch 118 in contact with the article 102 would be actuated, triggering an alarm.

Figure 3B:
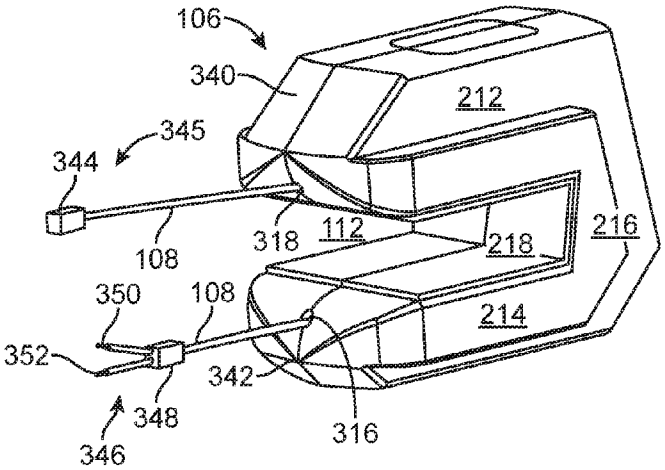
FIG. 3B is a non-limiting exemplary illustration of the EAS theft deterrent tag of FIGS. 1A to 3A, but without the first member to illustrate the distal ends of an adjustable piece in accordance with the present invention.
Figure 3A:
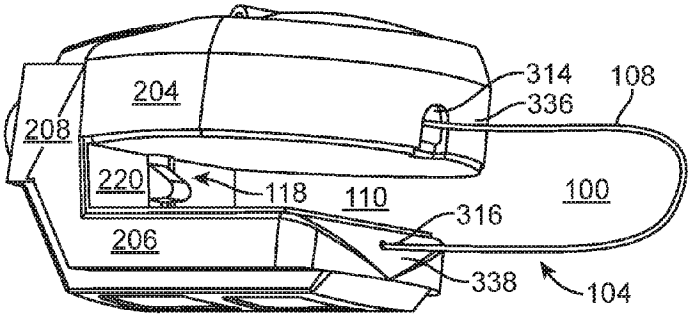
FIG. 3A is a non-limiting exemplary illustration of the EAS theft deterrent tag of FIGS. 1A to 2B, but without the second member in accordance with the present invention.

FIG. 3A is a non-limiting exemplary illustration of the EAS theft deterrent tag of FIGS. 1A to 2B, but without the second member, and the FIG. 3B is a non-limiting exemplary illustration of the EAS theft deterrent tag of FIGS. 1A to 3A, but without the first member. FIG. 3C is a non-limiting exemplary illustration of the EAS theft deterrent tag of FIGS. 1A to 3B, illustrating interior details of the tag. As illustrated in FIG. 3A, the EAS tag 100 may comprise only the main member 104 (without the second member 106) that may be coupled with an article 102 and an adjustable piece 108 that may be looped around the article 102 and manipulated by the reel mechanism for a tight engagement of the main member 104 with the article 102. As further illustrated, the adjustable piece 108 has a first end 344 (FIG. 3B) and a second end 346 coupled with the respective main first and main second parts 204 and 206 of the main member 104, and a lanyard body that forms a loop. The first end 344 of the adjustable piece 108 extends out of a main upper front aperture 314 of a main upper front area 336 of the main first part 204 of the main member 104 with the body of the adjustable piece 108 looped and entering into the main second part 206 of the main member 104 via a main lower front aperture 316 of a main lower front area 338 of the main second part 206, with the second end 348 of the adjustable piece 108 coupled with the electronics of the internal alarm system accommodated in the main second part 204 of the main member 104. More particularly, the first end 344 of the adjustable piece 108 is coupled with the reel mechanism 322 (FIG. 3C), and the second end 346 of the adjustable piece 108 is coupled with the housed electronics; and the adjustable piece body is looped and lassoed around the article 102. The main member 104 is tightly secured with the article 102 when the adjustable piece 108 is contracted by the reel mechanism 322.

Alternatively, as best illustrated in FIGS. 1A to 3C, the adjustable piece 108 may have a first end 344 and a second end 346 coupled with the respective main first and second parts 204 and 206 of the first member 104, and a lanyard body that loops through the second member 106. That is, the first end 344 of the adjustable piece extends out of the main first part 204 of the first member 104 with the body of the adjustable piece 108 entering the first part 212 of the second member 106, looping through the second member 106 and existing the second part 214 of the second member 106 and into the main second part 206 of the main first member 104, with the second end 346 of the adjustable piece coupled with the second part 206 of the first member 106. More specifically, the first end 344 of the adjustable piece is coupled with the reel mechanism 322, with the second end 346 coupled with the housed electronics in the main second part 206. The adjustable piece body is accommodated by the second member 106, and is looped there-through over a roller mechanism 304 and 306 to facilitate ease of adjustability of the adjustable piece 108 to one of an extended and a contracted position.

Figure 3C:
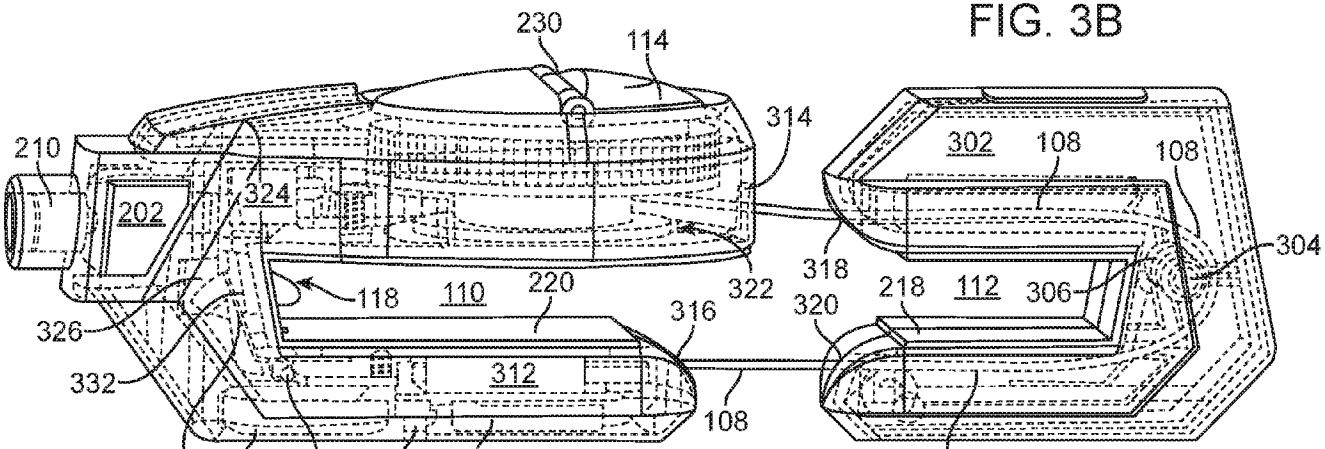
FIG. 3C is a non-limiting exemplary illustration of the EAS theft deterrent tag of FIGS. 1A to 3B, illustrating interior details thereof in accordance with the present invention.

In particular, as best illustrated in FIGS. 3B and 3C, the second member 106 is comprised of a hollow chamber 302 having a first opening 318 in a top front area 340 of the first part 212 of the second member 104, through which the adjustable piece 108 is extended. The second member 106 further includes a second opening 316 in a bottom front area 342 of the second part 214 of the second member 106, through which the adjustable piece 108 is extended. As best illustrated in FIG. 3B, the interior 302 of the second member 106 includes a cavity that enables free maneuverability of the adjustable piece 108, and a roller housing 304 that accommodates the roller 306 to reduce the friction of the adjustable piece 108 (as it rolls over the roller 306) when expanded or contracted.

Figure 4:
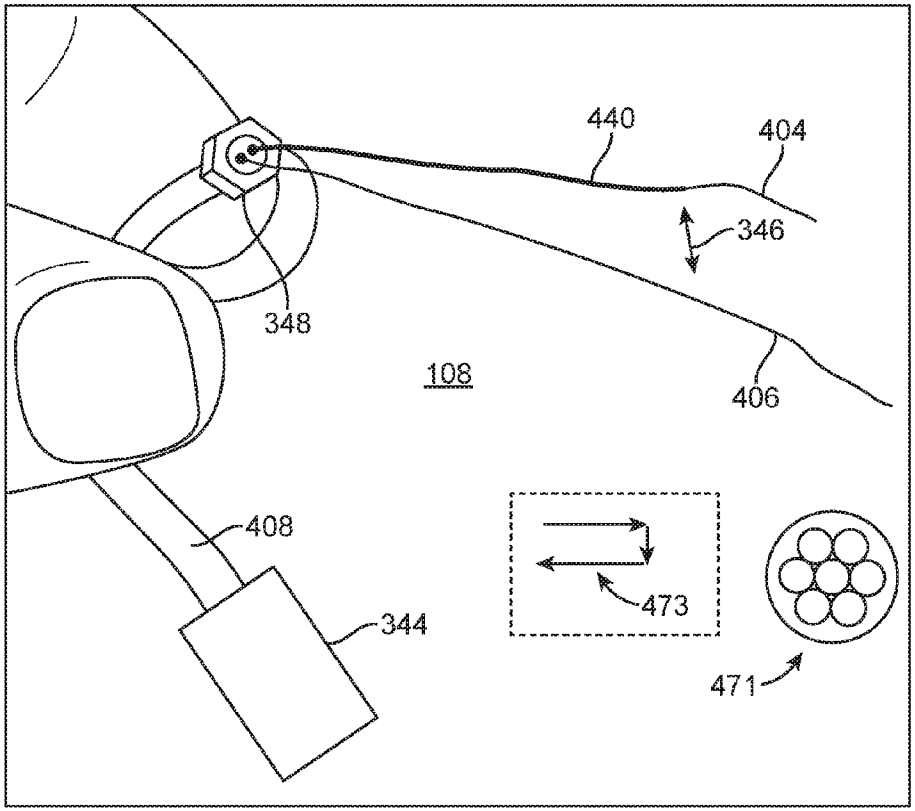
FIG. 4 is a non-limiting exemplary illustration of the adjustable piece in accordance with the present invention.

FIG. 4 is a non-limiting exemplary illustration of the adjustable piece in accordance with the present invention. As illustrated, the adjustable piece 108 is comprised of a multi-wire sense loop cable, having inner conductors enclosed within and inside outer conductors. The inner conductors are longitudinally insulated from one another and from the outer conductors by inner dielectric layers, with an outermost outer conductor of outer conductors longitudinally insulated by an outer dielectric layer. A first distal end 344 of the cable is comprised of short-circuited first end of the inner and outer conductors, and a second distal end 346 of the cable is comprised of second ends 350 and 352 of the inner and outer conductors connected to respective ground (GND) and High of an electronic circuit housed inside the main second part 206 of the main member 104, forming the sense loop cable. The shorted-circuited first end 344 of the inner and outer conductors comprises electrical and mechanical connection of a first end of the inner and outer conductors, and the second ends 350 and 352 of the inner and outer conductors comprise electrical and mechanical connection with a Printed Circuit Board (PCB) of the electronic circuit housed inside the main second part 206 of the main member 104. As illustrated, the first distal end 344 includes a locking plug that encapsulates the short-circuited first end of the one or more inner and outer conductors.

As detailed in FIG. 4, the adjustable piece 108 is comprised of one or more insulated inner conductors 404 enclosed within and inside one or more insulated outer conductors 408, with a cross-section thereof illustrated and referenced as element 471 in FIG. 4. The inner conductors 404 are longitudinally insulated from one another and from the insulated outer conductors 408 by one or more inner dielectric layers 440. A transparent outer dielectric layer further longitudinally insulates the outermost outer conductor. In other words, all conductors are independently insulated from one another, with the exception of their first and second ends. The first distal end of the adjustable piece 108 (within the encapsulated locking plug 344) is comprised of short-circuited first ends of the inner and outer conductors 404 and 408, with the locking plug 344 encapsulating the short-circuited first ends. That is, the first end of the inner conductors 404 are mechanically and electrically connected ("pinched" together) with the first end of the outer conductors 408, forming a short-circuited return wire (referenced as 473 in FIG. 4), and encapsulated within the locking plug 344.

The second distal end 346 of the adjustable piece 108 is comprised of second ends 350 and 352 of the inner and outer conductors 404 and 408, which are coupled to a printed circuit board, resulting in a sense loop cable. As further illustrated, the second distal end 346 further includes a conductive connector 348 that secures the inner and outer conductors 404 and 408, and securely maintains an extension 406 of the outer conductors 408. The inner and outer conductors 404 and 408 (and extension 406) are coupled with ground GND and an input of a microprocessor (detailed below). Also illustrated is an insulating layer 440 for the inner conductor 404. As illustrated, at least one of the conductors (in this exemplary instance the outer conductors 408) is an internal spirally-wrapped electrical conductive cord that is bulky and strong for added mechanical strength to secure an article 102. Accordingly, the extension 406 (electrically and mechanical connected with the bulky outer conductor 408 via the conductive connector 348) is used as the extension of the conductor 408 so to fit inside the first member 104 of the EAS tag 100, and allow outer conductor 408 to mechanically and electrically connected with the electronics of the EAS tag 100 via the less bulky extension 406.

Figure 5A:
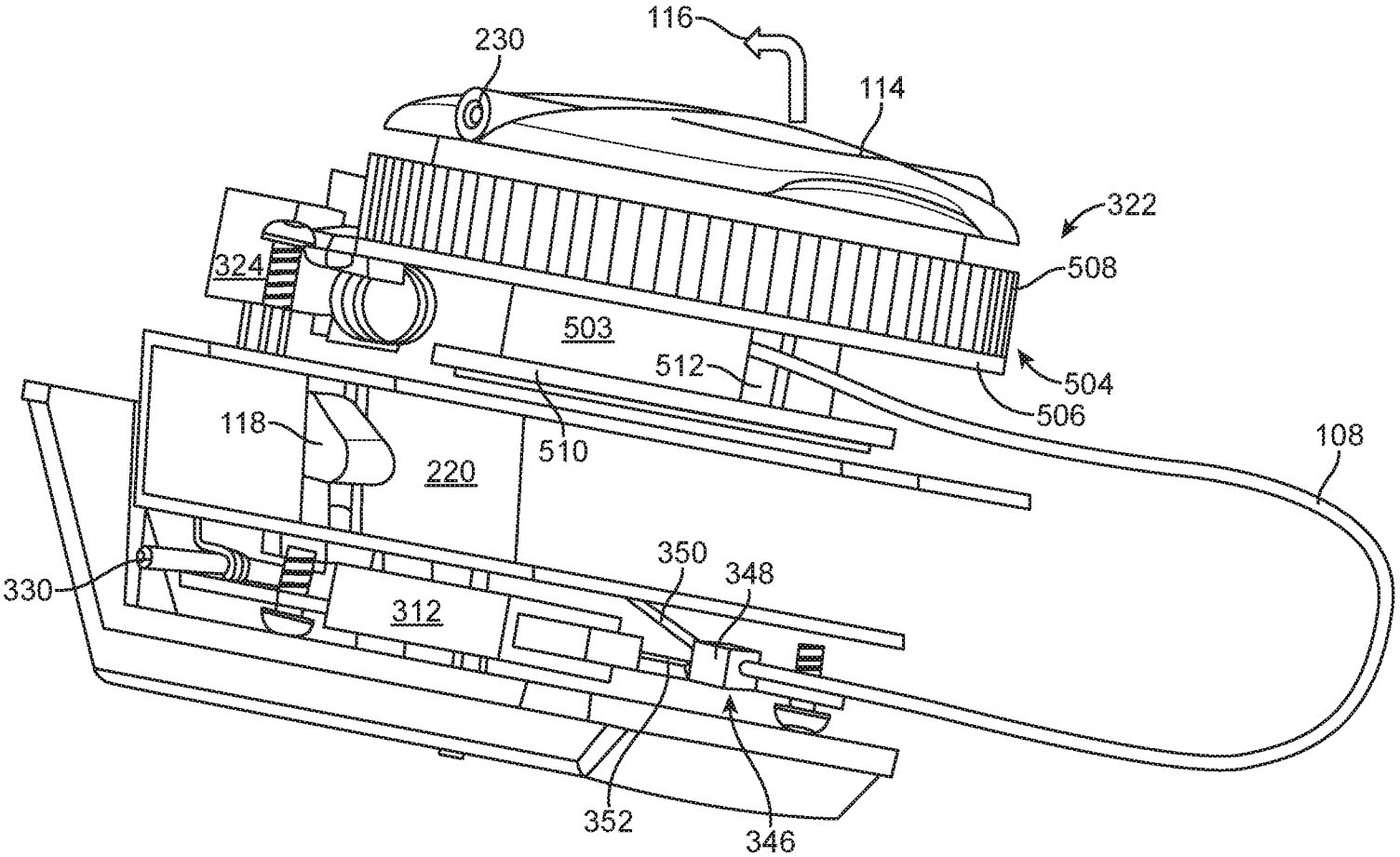
FIGS. 5A to 5C are non-limiting exemplary illustrations of the various views of a coupling of the adjustable piece with the first member of the EAS theft deterrent tag in accordance with the present invention.
Figure 5B:
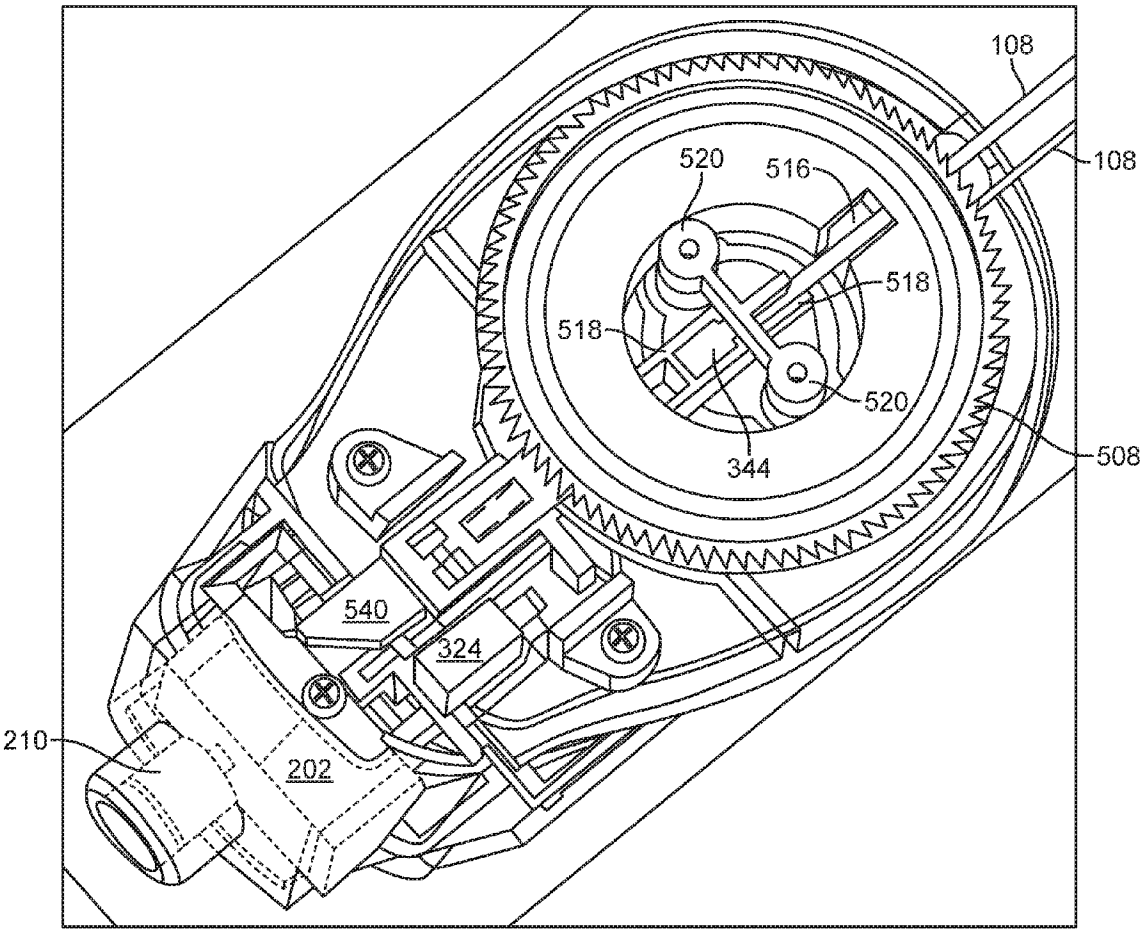
Figure 5C:
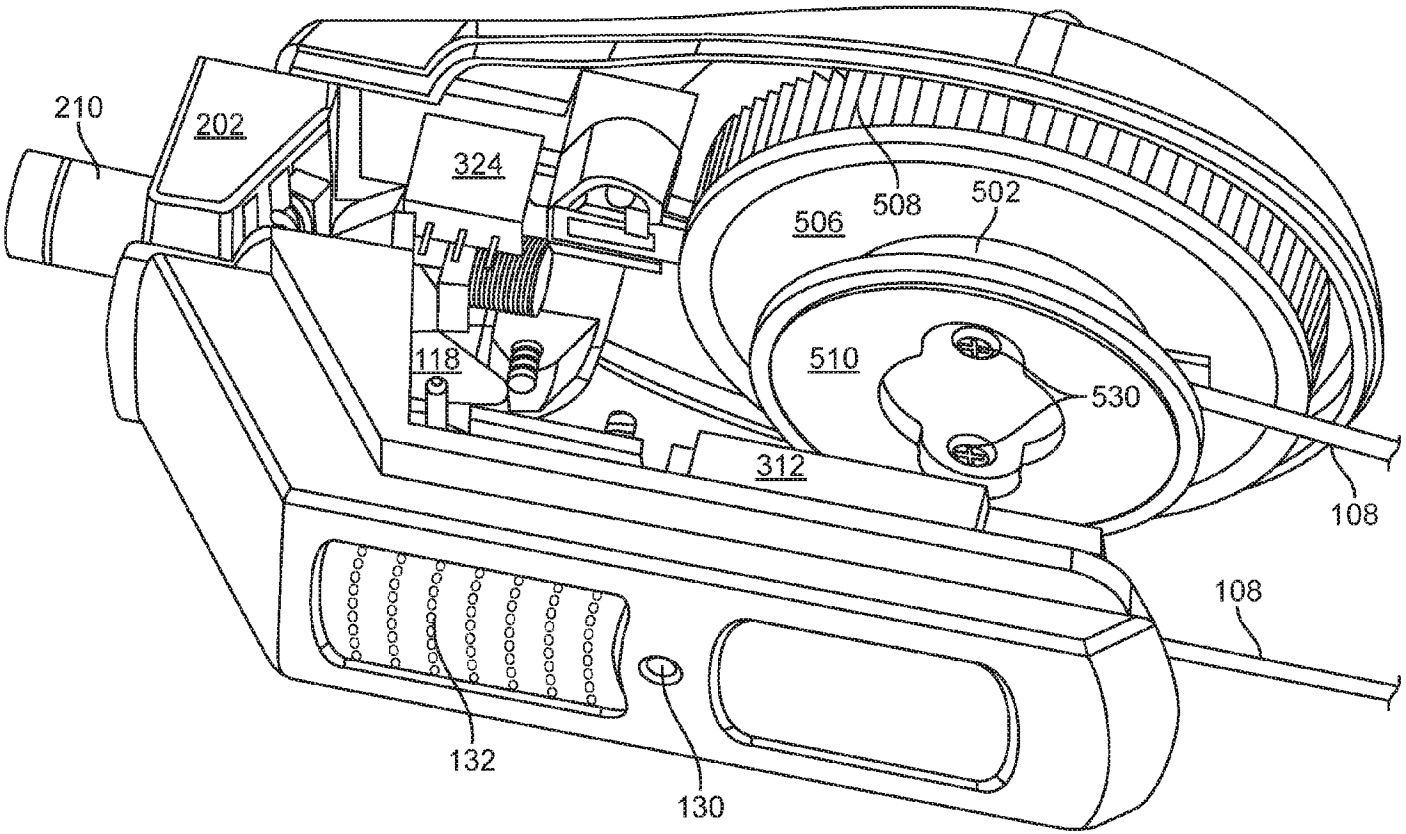

FIGS. 5A to 5C are non-limiting exemplary illustrations of the various views of a coupling of the adjustable piece with the first member of the EAS tag in accordance with the present invention. As illustrated in FIGS. 3A, 3B, and 5A to 5C, the first end 345 and the second end 346 of the adjustable piece 108 are coupled with the respective main first and second parts 204 and 206 of the first member 104, and the body of the adjustable piece 108 looping through the second member 106. As more specifically illustrated in FIGS. 5A to 5C, the first end 345 of the adjustable piece 108 is coupled with reel mechanism 322, and the second end 346 is coupled with the electronics housed in the main second part 206 of the main member 104. As stated above, the first end 345 of the adjustable piece 108 includes the encapsulation 344 that is inserted through a reel aperture 512, an internal reel guide channel 516, and permanently accommodated inside a housing 518 within the reel mechanism 322. The second end 346 is coupled with the electronics located inside the main second part 206 of the first member 104 and more specifically, with one end 350 or 352 of the multi-wire adjustable piece 108 coupled with ground and the other 352 or 350 coupled with the microprocessor. Accordingly, when the handle 114 is flipped to an open position along the path 116 and rotated along path 222, the reel mechanism 322 pivots and the adjustable piece 108 is either contracted or extended (depending on the direction of rotation of the reel), which enables the adjustable piece 108 to wind onto the reel 322 for contraction or wind off the reel for extension. As a result, the first and second members 104 and 106 may be maneuvered to opposite directions when the adjustable piece 108 is extended (winds off the reel), and the first and second members 104 and 106 are maneuvered towards each other when the adjustable piece 108 is contracted (winds onto the reel).

As further illustrated (in FIG. 3C in addition to FIGS. 5A to 5C), the reel mechanism 322 is accommodated within a through-hole, transverse the longitudinal axis of the main first part 204 of the first member 104. The reel mechanism 322 is comprised of a revolving spool 504 with the handle 114. The handle 114 is coupled with the spool 504 via a pair of fasteners 530 that are inserted through a pair of posts 520 that form the connection point of the handle 114 with the spool 504. The spool 504 is comprised of a first flange 506, a second flange 510, and a spool body 503, with the first flange 506 having a wider span than the second flange 510. The first flange 506 has a periphery that includes a wall that is serrated 508 along an exterior facing side. The spool body 503 in between the first and second flange 506 and 510 accommodates a majority portion of the adjusting piece 108 when contracted, and includes the opening 512 for insertion and interlocking of a first end 345 of the adjustable piece 108 at a substantial center of the spool body 503.

Figure 6A:
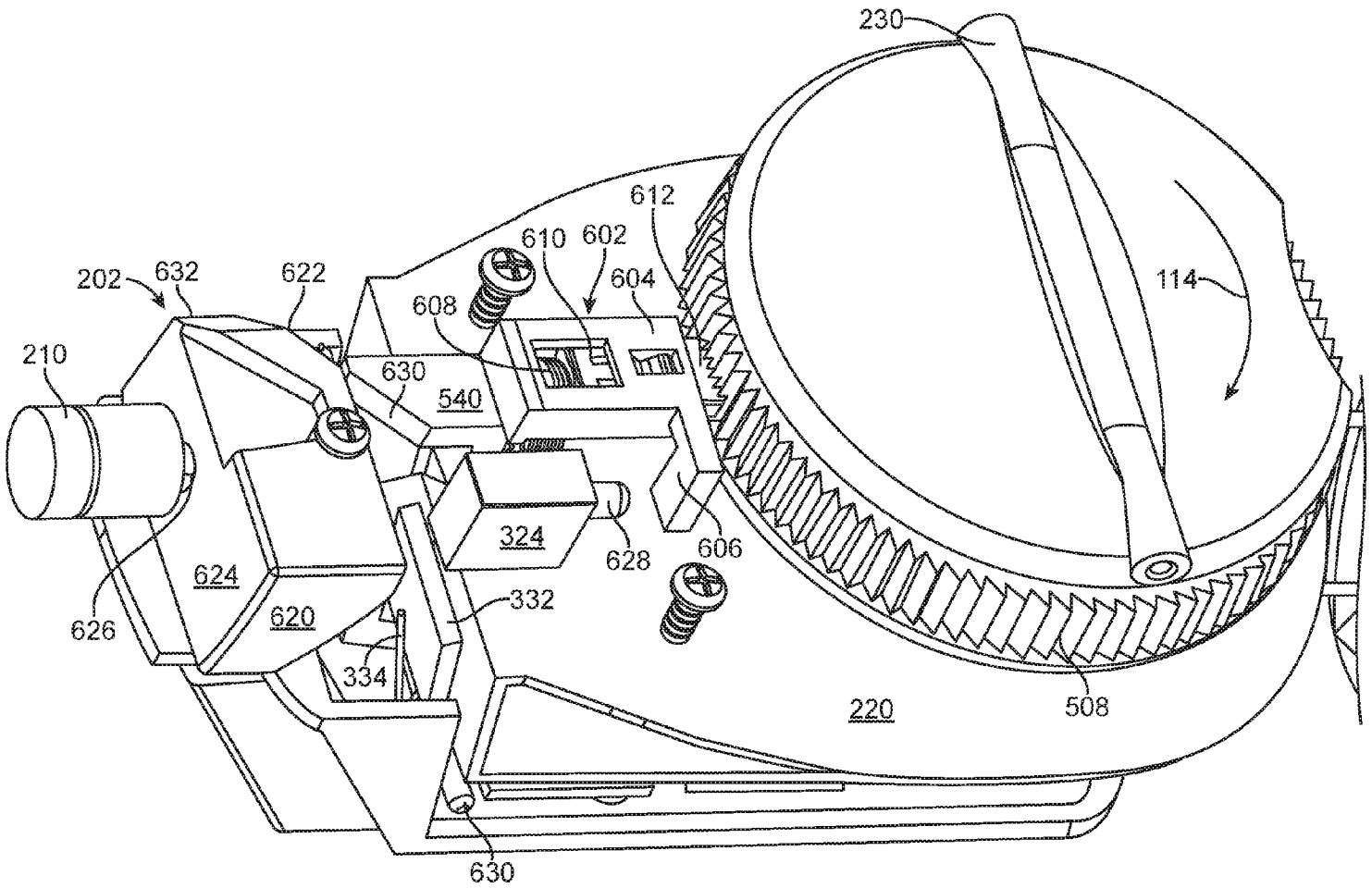
FIGS. 6A to 6C are non-limiting exemplary illustrations that detail the various views of a power switch used with the EAS theft deterrent tag of FIGS. 1A to 5C in accordance with the present invention.
Figure 6B:
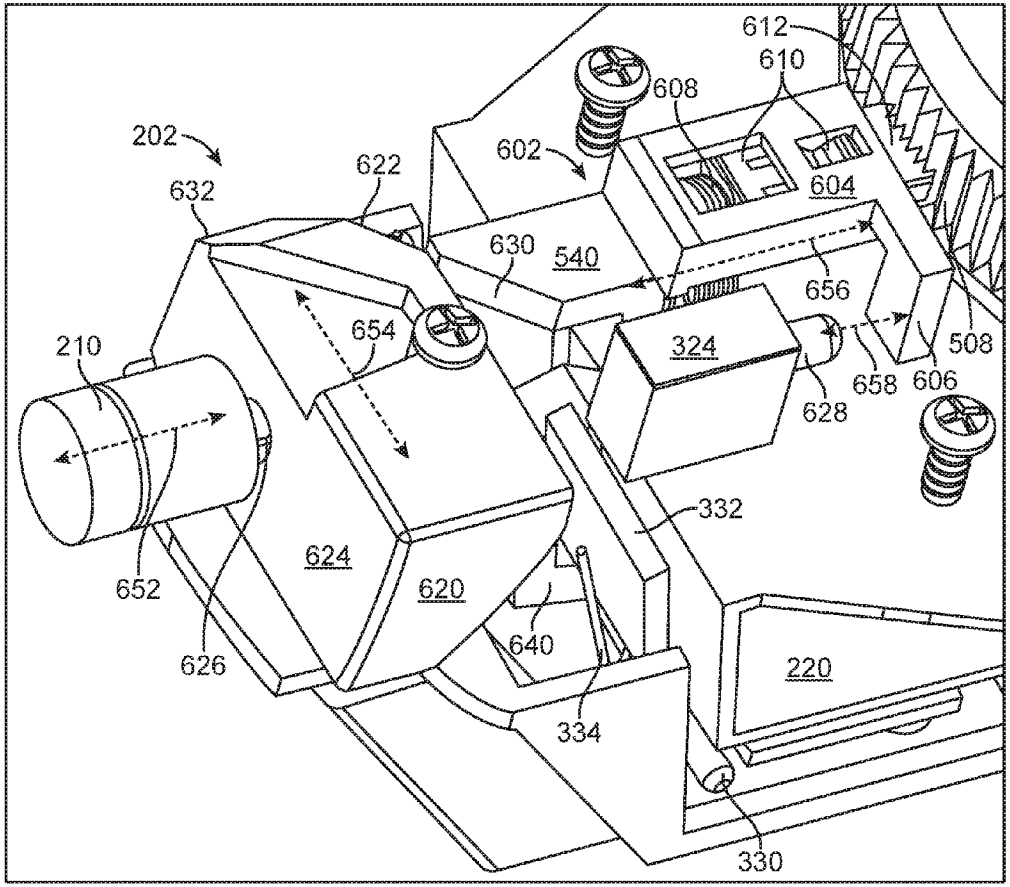
Figure 6C:
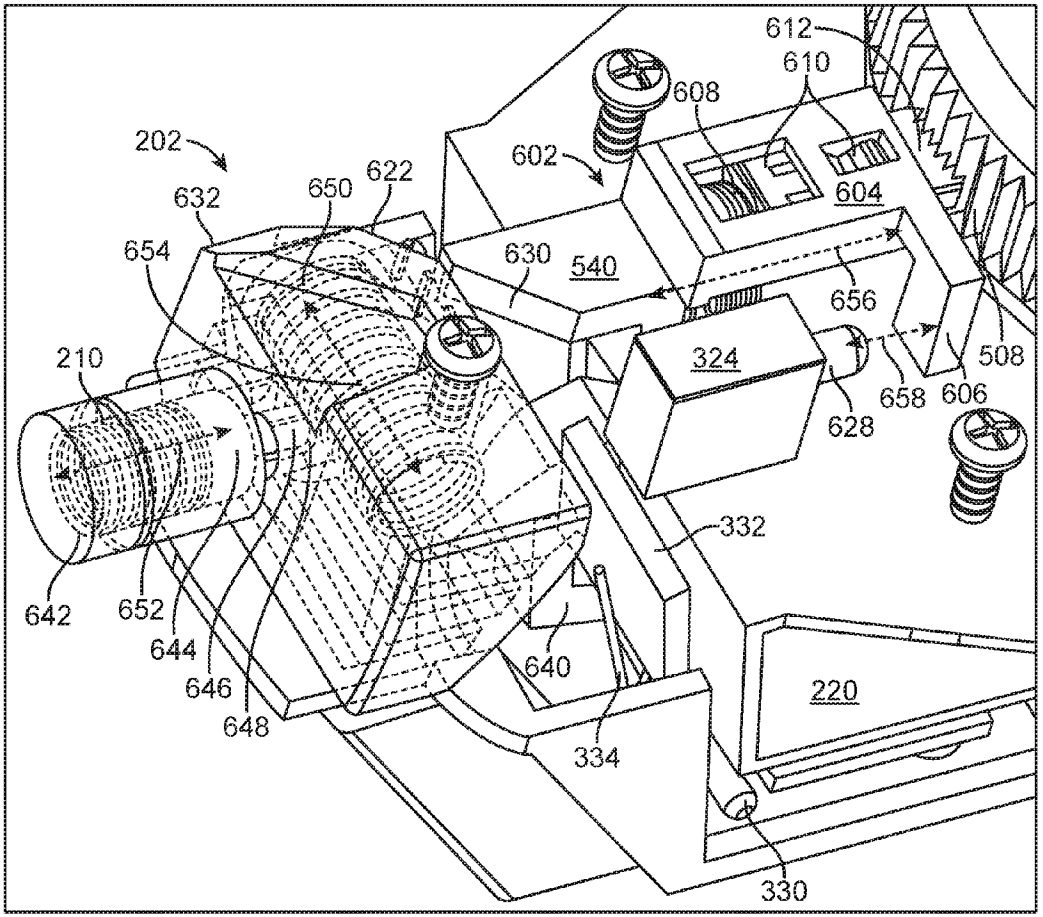
Figure 7A:
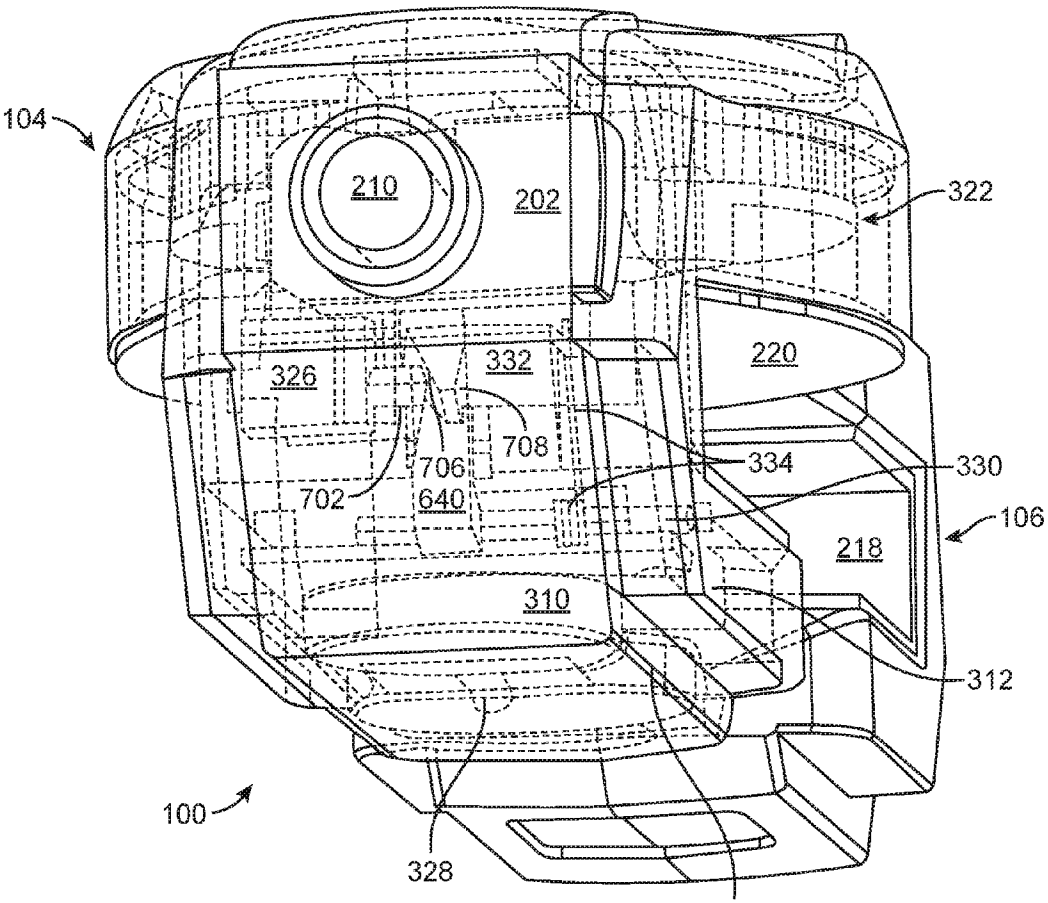
FIGS. 7A to 7E are non-limiting exemplary illustrations that detail the various views of an alarm switch used with the EAS theft deterrent tag of FIGS. 1A to 6C in accordance with the present invention.
Figure 7B:
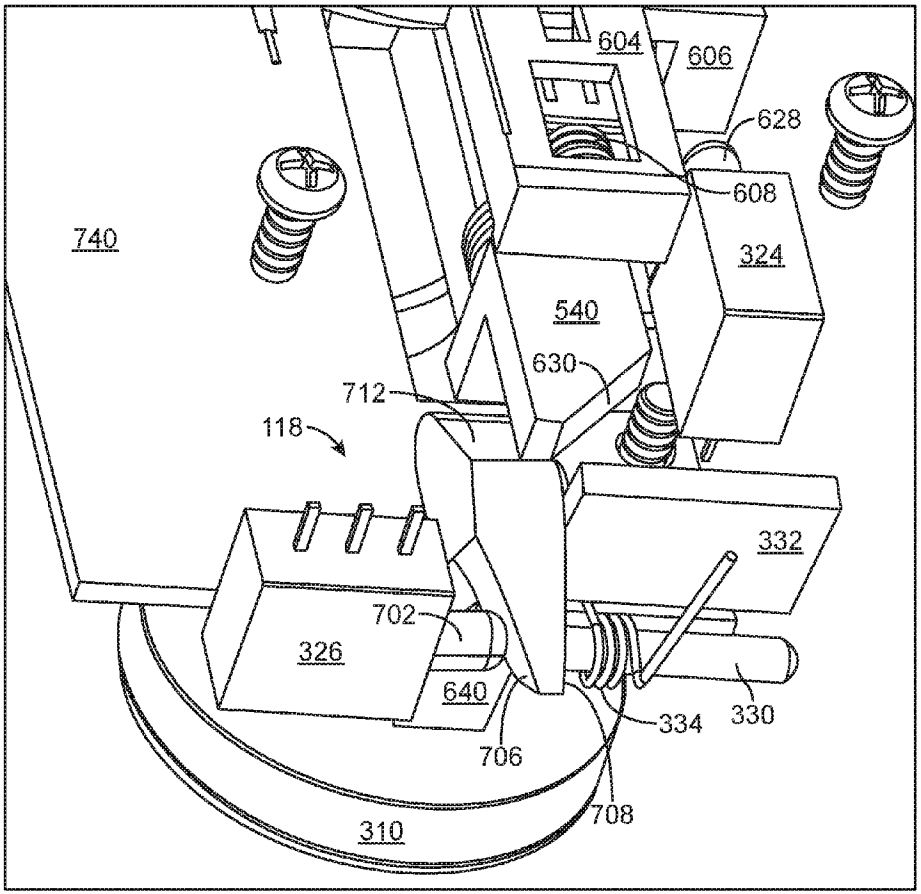
Figure 7C:
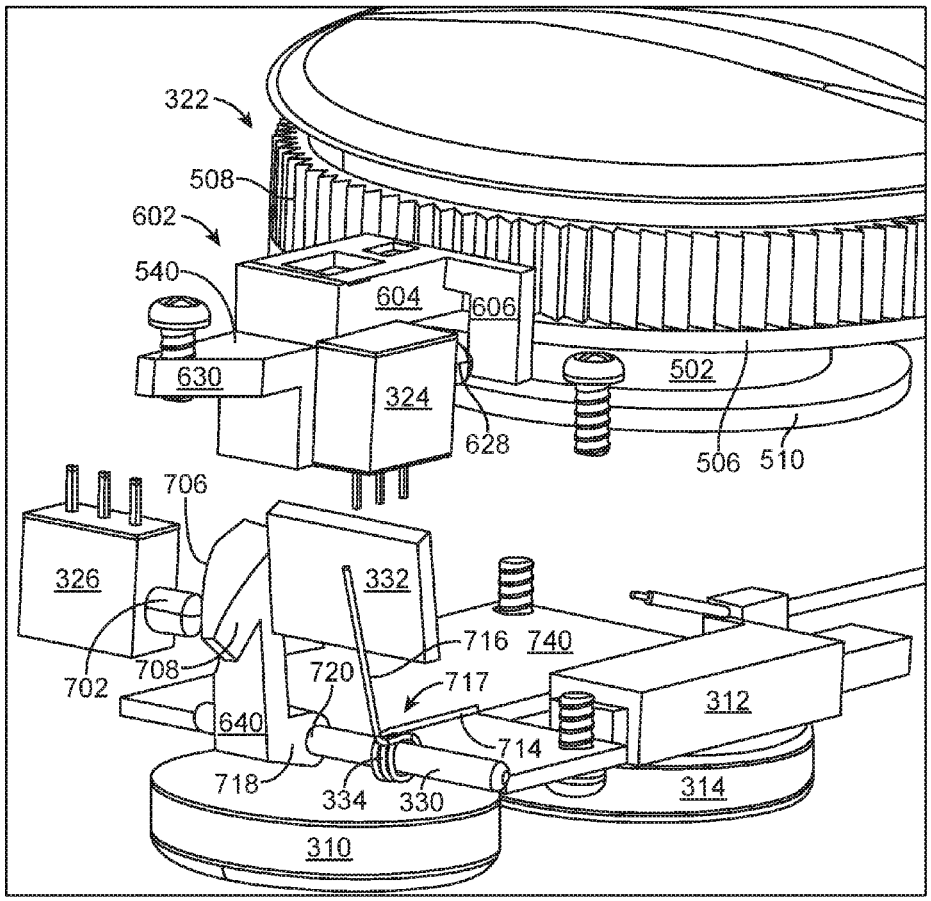
Figure 7D:
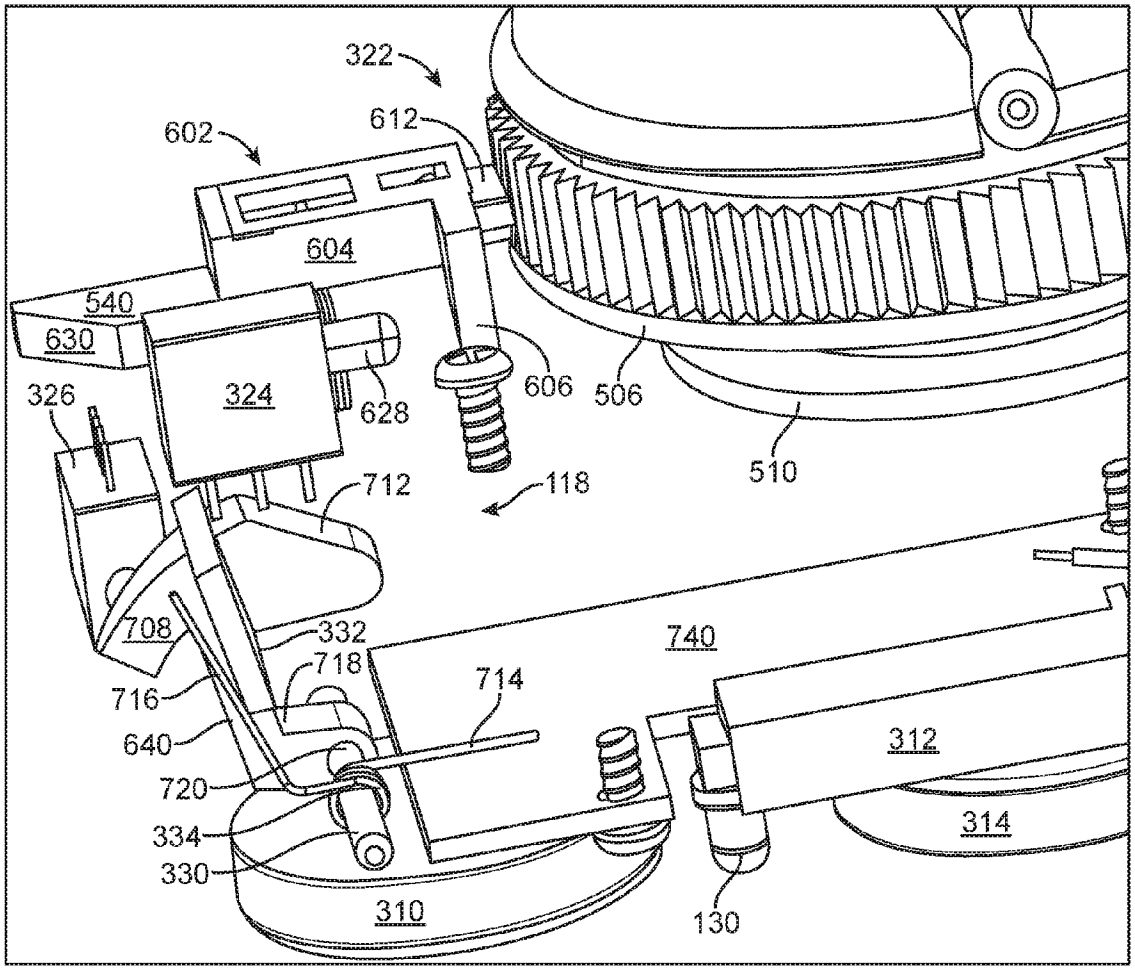
Figure 7E:
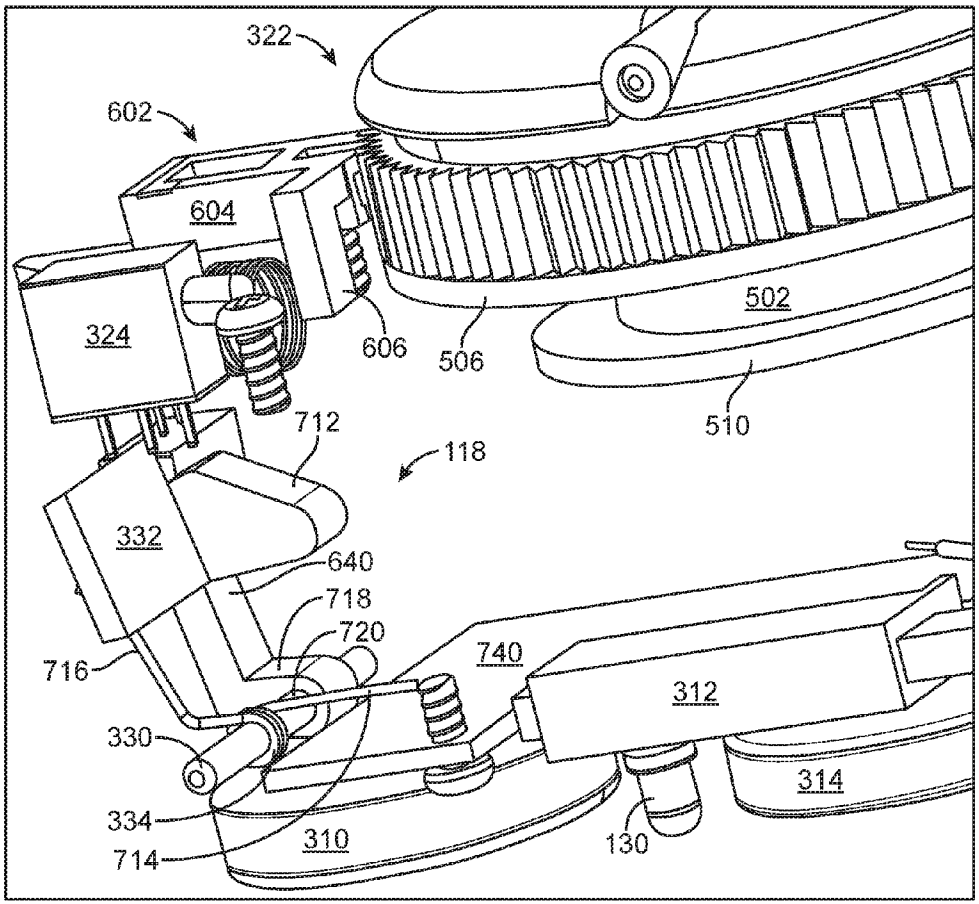

Referring back to FIG. 3C, as illustrated, the main first part 204 of the first member 104 accommodates (amongst others) a power switch 202, the details of which are illustrated in FIGS. 6A to 6C. Accordingly, FIGS. 6A to 6C detail the various views of a power switch used with the EAS tag of FIGS. 1A to 5C in accordance with the present invention. As illustrated in FIGS. 6A to 6C, the power switch 202 is moved along a reciprocating path 654, transverse a longitudinal axis of the first member 104 to actuate a power plunger switch 324 to enable supply of power to an internal alarm system of the EAS tag 100. In general, the power switch 202 is biased, extending out of a lateral rear side of the main first part 204 of the first member 104 when in open (power OFF) position by a biasing mechanism 650, which includes clutch interlock aperture 626 for detachably interlocking with a clutch 644 when in closed position (power ON), and a beveled side 622 that progressively engages with an intermediate member 602 for actuating the intermediate member 602 along a reciprocating path 656 that is transverse the reciprocating path 654 of the power switch 202 to thereby release a plunger 628 of the power plunger switch 324 when the power switch 202 reaches a closed position (power ON). Accordingly, the power switch 202 is an asymmetrical element comprised of a first side 620 that extends out of the lateral rear side of the main first part 204 to allow users to press the power switch 202 and move it against the bias of the resilient member 650 (e.g., spring 650) to commence supply of power to the electronics of the EAS tag 100 and turn it to ON. The opposite side of the first side 620 of the power switch 202 has a flat portion 632 and a beveled portion 622, with the beveled portion engaging the beveled section 630 of the intermediate member 602. The rear side 624 of the power switch 202 including the clutch interlock aperture 626 for detachably interlocking with a clutch 644 against the bias of the resilient member 650 when in closed position (power ON).

As further illustrated in FIGS. 6A to 6C, the clutch housing 210 accommodates the clutch 644 and a clutch biasing mechanism 642. The clutch biasing mechanism 642 is biased to move the clutch 644 in the direction indicated by the reciprocating path 652, allowing the engaging tip 646 to be moved and pushed inward extending and snapping into the clutch interlock aperture 626, and interlock with the interlock housing 648 of the power switch 202. The engagement of the engaging tip 646 with the interlock housing 648 interlocks with and maintains the power switch 202 in the ON position, against the bias of the biasing mechanism 650. The overall interlocking scheme of the clutch 644 with the power switch 202 as a result of their respective biasing mechanisms provides a mechanical biasing scheme that generates a holding strength that is increased under tensile and compression forces that attempt to separate the components when both are interlocked with one another.

As further illustrated in FIGS. 6A to 6C, when in the closed position (power ON), the beveled side 622 of the power switch 202 progressively engages with the intermediate member 602 for actuating the intermediate member 602 along a reciprocating path 656 that is transverse the reciprocating path 654 of the power switch 202 to thereby release a plunger 628 of the power plunger switch 324 when the power switch 202 reaches a closed position (power ON).

The intermediate member 602 includes a blade-like section 540 that has a beveled end 630 that engages with the beveled side 622 of the power switch 202 to actuate the intermediate member body 604 along the path 656 to engage or disengage a lateral flange 606 with the plunger 628 of the power plunger switch 324 to turn ON or OFF supply of power to the electronic components of the EAS tag 100. As illustrated, the lateral flange 606 extends substantially perpendicular an axial length of the intermediate member body 604 and has flange surface that can engage with the plunger 628.

As further illustrated, the intermediate member 602 accommodates an interlocking member 610 and biasing mechanism 608 within the intermediate member body 604. The biasing mechanism 608 urges the interlocking member 610 along the path 656 towards the spool 504 of the reel mechanism 322. The interlocking member 610 includes beveled serrations 612 at a first end thereof, which are oriented at a first direction that interlock with beveled serrations 508 of the spool 504 of the reel mechanism 322 that are oriented at a second, opposite direction. The spool 504, and the interlock member 610 and biasing mechanism 608 form a ratchet and pawl mechanism, wherein the ratchet wheel may be construed as the spool 504 and the pawl as the interlocking member 610, with the beveled serrations 612 of the pawl forming a first set of sloped teeth, and the beveled serrations 508 of the spool 504 forming a second set of oppositely oriented sloped teeth. When the spool teeth 508 are moving in a first direction, the pawl teeth 612 slide up and over gently sloped edges of the spool teeth 508, with biasing mechanism 608 in a form of a spring forcing the pawl teeth 612 into the depression between the spool teeth 508 as the pawl teeth 612 pass the tip of each spool tooth 508. When the spool teeth 508 move in a second, opposite direction, the pawl teeth 612 catch against steeply sloped edge of a first tooth of the spool teeth 508 that the pawl teeth 612 encounter, thereby locking the spool 504 against the pawl tooth and preventing any further motion of the spool 504 in the second direction. Accordingly, when fully mounted onto an article 102, the EAS tag 100 may be tightened, but cannot be loosened unless done so by an authorized person.

A magnetic detacher may be used to release and pull back the clutch 644 from its biased position, and out and away from the switch 202 to release the power switch 202 to an OFF position. To disengage the clutch from the switch 202, the engaging tip 646 is retracted, released, and disengaged from the interlocked and engaged position within the interlock housing 648 (and out and away from the clutch interlock aperture 626 of the power switch 202) when the force exerted by the resilient member 642 is removed. The engaging tip 646 is released, retracted and disengaged from the interlock aperture 626 when the force exerted by the resilient member 642 is reversed, with the reversed force pulling the engaging tip 646 out and away from the interlock aperture 626, against the biasing mechanism 642. That is, to release an article, deactivate, and reset the alarm to OFF, the clutch housing 210 is brought into physical contact with a well-known suitable (in terms of magnetic strength, for example) magnetic detacher that enables the release and removal of the engaging tip 646 from the switch 202, and the overall powering OFF of the EAS alarm tag 100. The magnetic detacher magnetically pulls-in the clutch 644 in the reciprocating path 652 against the push of the biasing mechanism 642 (compresses the illustrated spring 642) to thereby pull-out the engaging tip 646 away from the switch 202.

The disengagement of the clutch 644 from the switch 202, releases the force exerted on the biasing mechanism 650, which pushes the switch 202 back to its Off position along path 654. The release of the switch 202 to its OFF position reverses the actuation of the intermediate member 602, compelling flange 606 to contact and close plunger 628 to shut-OFF power to the internal alarm system. Further, the reversal of the actuation of intermediate member 602 also disengages the beveled serrations 612 of the intermediate member 610 from the beveled serrations 508 of the spool 504, enabling the reel mechanism 322 to rotate to extend the adjustable piece 108 and release the article.

Referring back to FIG. 3C, as illustrated, the main third part 208 of the first member 104 accommodates (amongst others) an alarm switch 118, the details of which are illustrated in FIGS. 7A to 7E. Accordingly, FIGS. 7A to 7E are non-limiting exemplary illustrations that detail the various views of an alarm switch used with the EAS tag of FIGS. 1A to 6C in accordance with the present invention. As illustrated in FIGS. 7A to 7E, the alarm switch 118 is comprised of a substantially T (or "hammer" like) configuration that includes a handle section 640 and a head section. A lower end of the handle section 640 is comprised of a pivot arm 718 that ends in a pivot aperture 720 that accommodates a pivot shaft 330, enabling the alarm switch 118 to pivot along a reciprocating path substantially parallel the longitudinal axis of the first member 104 to one of actuated and non-actuated positions. The upper end of the handle section 640 is coupled with the head section, which includes an engaging portion 712 that contacts with the article. The head section further includes a first lateral beveled engaging portion 706 that closes an alarm plunger switch 326 when the alarm switch 118 is actuated, and a second lateral flat section 708. Further associated with the alarm switch 118 is a biasing surface 332 that is coupled with the handle section 640 and maintains the alarm switch 118 to a non-actuated position by a contacting biasing mechanism 717. Once the biasing surface 332 is pushed (as a result of an article 102 pushing against the alarm switch 118), the beveled edge 706 slides and pushes the plunger 702 of the alarm plunger switch 326 to set the internal alarm. The contacting biasing mechanism 717 is comprised of a first end 716 that contacts the biasing surface 332, a resilient section 334 that is mounted onto the pivot shaft 330, and a second end 714 that contacts the base-board 740 of the alarm tag to maintain the alarm switch 118 to an OFF position.

Figure 8A:
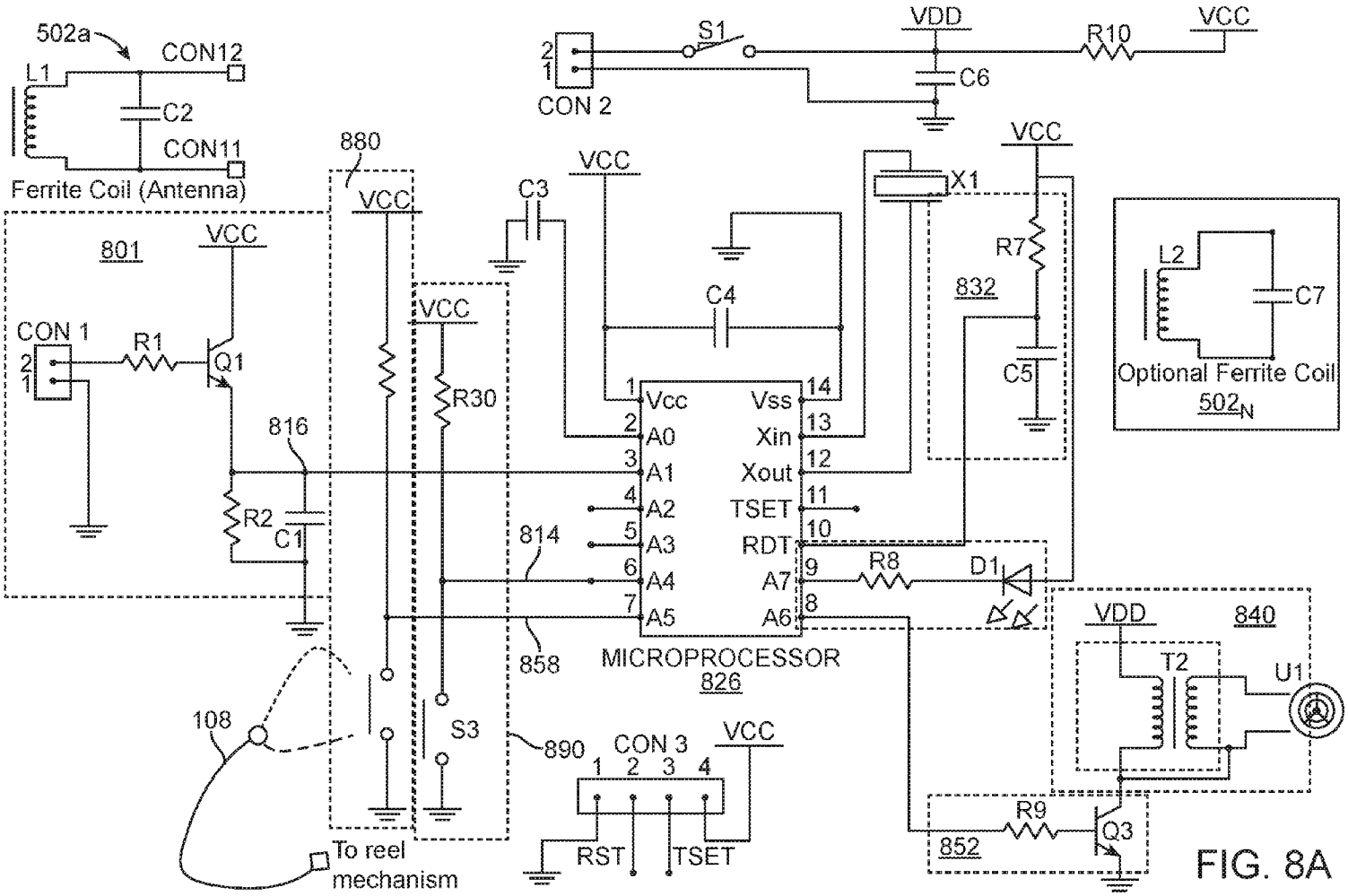
FIGS. 8A to 8C are non-limiting exemplary illustrations of a circuit schematic illustrating a circuit topography of an alarm system of the EAS theft deterrent tag of FIGS. 1A to 7E in accordance with the present invention.

FIG. 8A is an exemplary illustration of the circuit schematics illustrating the circuit topography of the alarm system in accordance with the present invention. As illustrated, the EAS tag 100 includes a plurality of independent mechanical and electrical circuitry that function to protect the article 102 with which the EAS tag 100 is coupled for protection. A first module in an exemplary form of a power switch 202 has associated with it a first independent mechanical and electrical circuitry that powers the EAS tag 100. A second module in the form of the exemplary adjustable piece 108 (best illustrated in FIGS. 8B and 8C) has associated with it a second independent mechanical and electrical circuitry that enables a trigger of an alarm in case of tampering. A third module in the form of the exemplary arming mechanism 118 has associated with it a third independent mechanical and electrical circuitry that sets (or arms) the alarm tag and triggers an alarm in case of tampering. Finally, a fourth module in the exemplary form of one or more transponders 502*a*, 502*b*, . . . $\mathbf{502}_N$ that are associated with a fourth independent mechanical and electrical circuitry that receive or send signals, and trigger an internal and external alarms in case of an unauthorized removal of an article from a secure surveillance zone.

As illustrated in FIG. 8A, power is supplied to the power connector CON2 via a power source such as the illustrated battery 310, and switched ON by the switch S1, providing the power VCC to the illustrated circuit. The switch S1 is a schematic representation of the power plunger switch 324, the actuation of which is described above in relation to FIGS. 6A to 6C. Therefore, when switch S1 in FIG. 8A is closed, VCC power is supplied to the various components of the alarm circuit shown in FIG. 8A, with the power filtered through the capacitor and resistor combination C6 and R10.

In FIG. 8A, the dashed-line box indicated as reference 890 generally represents (schematically) the alarm switch 118 (detailed in FIGS. 7A to 7E) and its interconnections with the alarm system of the EAS tag 100, and the dashed-line box indicated as reference 880 generally represents (schematically) the adjustable piece 108 and its interconnections with the alarm system of the EAS tag 100.

As stated above, the first or main member 104 accommodates an alarm switch 118 that actuates upon securing the article within the gap 110. That is, the alarm switch 118 is actuated when a portion of the article is inserted within the "clips" and the body of the article is pressed against the alarm switch 118 that is protruded from the first or main member 104. Actuation of the alarm switch 118 sets the alarm of the alarm system. Therefore, the switch S3 (representing the alarm switch 118) closes upon securing the article within the gap 110. When the switch S3 is closed by the push of the article within the gap 110, the output of the switch S3 is pulled low or to ground and set to "0" from a high VCC via the current limiting resistor R30, and inputted to a first input line 814 of one or more input lines of a microprocessor 826 for activation (or arming) of the alarm tag 100. In general, output of the various modules pulled low or ground and set to "0" instruct the microprocessor 826 to arm the alarm. Therefore, when fully closed, the power switch 51 enables supply of power from the power source to the alarm system, and the output of the alarm switch S3 pulled low and set to "0" instructs the microprocessor 826 to arm the alarm.

Figure 8B:
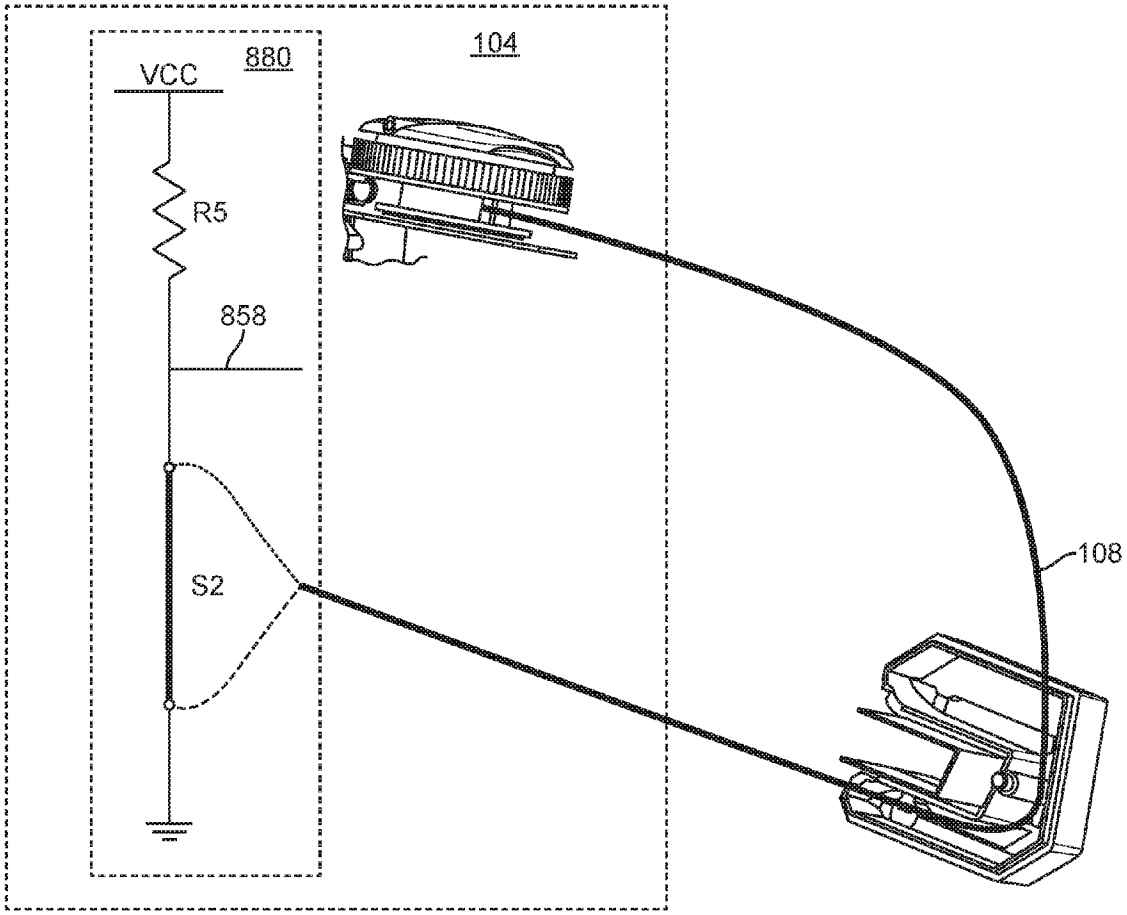
Figure 8C:
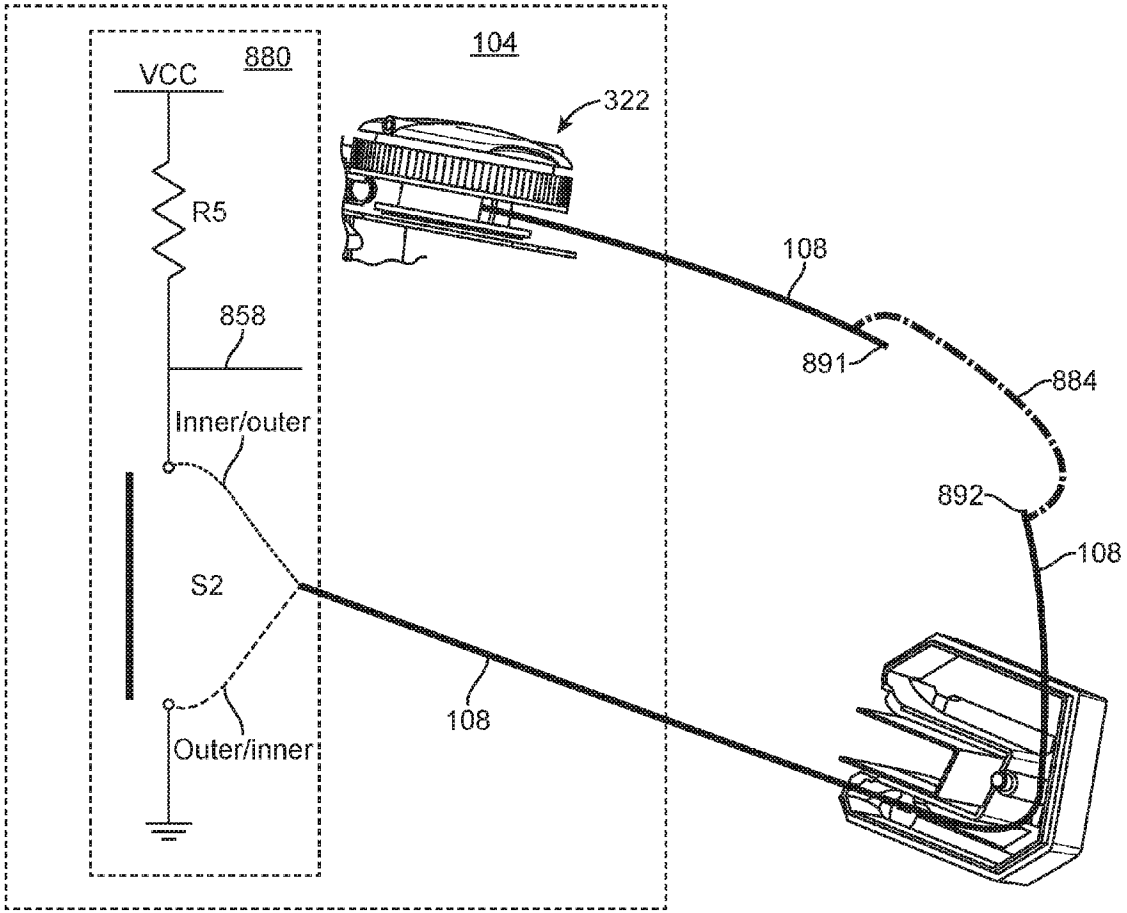

As stated above, the dashed-line box indicated as reference 880 generally represents the adjustable piece 108 and its interconnections with the alarm system of the EAS tag 100. As further illustrated in FIG. 8A and described in detail above, the second distal end 346 of the adjustable piece 108 is coupled with the PCB, which is schematically represented by the switch S2 for better understanding. The switch S2 is virtual and is for illustrative purposes only. Switch S2 is used only to represent the open and closed circuit conditions of the adjustable piece 108 when the lanyard has a complete loop (i.e., switch S2 is closed) or when it is severed (i.e., switch S2 is opened). Therefore, the illustrated switch S2 is not real, but is a mere circuit representation of open or closed condition of the lanyard 108 closed loop circuit. Accordingly, the normal representation of this virtual "switch S2" is in its closed position (as shown in FIG. 8B) as soon as the second distal ends 346 of the inner and outer conductors are permanently connected to the input line 858 of the microprocessor 826 via the Printed Circuit Board (PCB). Therefore, the closed switch S2 represents a complete, internally short-circuited, electrically closed-circuit loop of the lanyard 108 at its first distal ends 345 (encapsulated 344 within spool 504 as shown, and within the main member 104), with its second distal ends 346 connected to the PCB (also within main member 104), with one of the conductors connected to the microprocessor 826 (via line 858) and the other connected to the ground GND. When the switch S2 is closed (i.e., the first distal ends of the insulated inner and insulated outer conductors are electrically and mechanically connected together and the second distal ends of the adjustable piece 108 are mechanically and electrically connected to the input line 858 of the microprocessor 826 via the mechanical connection to the PCB and the ground), the output of the final connection (or the representative closed switch S2 shown in FIG. 8B) is pulled low and set to "0" via the current limiting resistor R5, and inputted to the input line 858 of one or more input lines of a microprocessor 826 for activation (or arming) of the alarm device of the EAS tag 100. With this configuration, the adjustable piece 108 is permanently connected to the reel mechanism of the main member 104 at its first end 345, looped through the second member 106, and permanently connected with the microprocessor 826 at its second end 346. Accordingly, in normal conditions (activated alarm or not), the virtual switch S2 will always remain closed as shown in FIG. 8B. However, as best illustrated in FIG. 8C, if the adjustable piece 108 is severed to release an article, even the use of jumper cables 884 will not prevent the sounding of an alarm. That is, jumper cable 884 may maintain the electrical circuit loop closed for the outer conductor only, but not the insulated inner conductor that is within and inside the outer conductor, and insulated from the outer conductor by a dielectric layer. That is, the jumper 884 may be mechanically and electrically connected to the severed ends of the 891 and 892 of the outer conductor, with the inner conductor severed and insulated from the outer conductor and the jumper 884. Therefore, when severing the lanyard 108 to disconnect and discontinue the physical loop to remove the secured article, the inner conductor will remain open circuited (symbolically represented as the open switch S2 in FIG. 8C) when lanyard 108 is cut, even if cable jumpers 884 are used. The open circuit condition (symbolically represented as the open switch S2) will pull the input line 858 to a high ("1"), which, in turn, will trigger the alarm.

Referring back to FIG. 8A, the alarm system further includes the general purpose microprocessor 826 mounted onto a PCB with an internal memory (e.g., an EEPROM) that includes a set of instructions. The microprocessor 826 receives one or more input signals from one or more input periphery devices and generates one or more processed output signals for actuation of one or more periphery output devices. The processing of data may include Analog to Digital (A/D) or D/A conversion of signals, and further, each input or pin of the microprocessor 826 may be coupled with various multiplexers to enable processing of several multiple input signals from different input periphery devices with similar processing requirements. Non-limiting examples of one or more input periphery devices may exemplarily include the power switch S1, the adjustable piece 108 (represented by the switch S2), the arming mechanisms S3, and the one or more transponders 502*a* to 502$_N$. Non-limiting examples of one or more output periphery devices may exemplarily include the use of vibration mechanisms, audio, visual or any other indicators to alarm and notify a user regarding an occurrence.

As exemplarily illustrated in FIG. 8A, the EAS tag 100 may use a first module in the form of the electronic article surveillance (EAS) transponders 502*a* coupled with an EAS connector CON 1, with the EAS transponders 502*a* comprised of a ferrite coil antenna that includes an inductor L1 and a capacitor C2. It should be noted that several transponder antennas 502*a* to 502$_N$ may be used, with each tuned to a different resonant frequency for activation of different types of pedestals, non-limiting examples of which may include AM, RF, Microwave, etc.

As illustrated, a first output of the EAS connector CON 1-1 is coupled with ground, and a second output of the EAS connector CON 1-2 is coupled with an amplifier 801 to generate an amplified signal from the EAS transponder 502*a*. The amplifier increases the signal strength from the EAS transponder 502*a* sufficiently for further processing by the alarming circuit. The amplifier is comprised of a current limiting resistor R1 that limits the current input to the base of the transistor Q1, with the transistor Q1 functioning to amplify the signal from EAS connector CON 1-2. The transistor Q1 is comprised of an exemplary NPN Bipolar Junction Transistor (BJT), with the collector coupled to power supply VCC and the emitter coupled to ground via a resistor-capacitor filter. It should be noted that present invention should not be limited to the amplifier illustrated, and other conventional amplifiers may also be used. Further, the amplification need not be performed by the BJT, but can be done by other transistors, such as Metal Oxide Semiconductors (MOS) or MOS field effect transistors (MOSFETS), operational amplifiers, transformers, or the like, other passive or active devices, or any combination thereof.

The output of the EAS transponder 502*a* is amplified by the amplifier 801, and the amplified signal (form the emitter of the transistor Q1) is input to the microprocessor 826 via the input line 816 as one of one or more input signals, where the microprocessor 826 converts the analog amplified signal into a digital signal for processing. This signal is translated by the instructions (algorithm) within the EEPROM of the microprocessor 826 to determine if the signal came from the transmitters (pedestals); if so, the microprocessor 826 will trigger the alarm (e.g., an audio and or visual indicator). It should be noted that one or more of the one or more processed output signals may be pulsed output signals on output line (pin 8) to one of the one or more periphery output devices, for example, for actuation of a transducer unit 840 to generate an audio alarm signal.

The transducer unit 840 is actuated by an amplified pulsed output signal that is output from the microprocessor 826 via line (pin 8), and further amplified by an output amplifier 852. The output amplifier 852 is comprised of a BJT transistor Q3 with an emitter coupled to ground, a collector coupled to a transformer T2 of the transducer 840, and a base that is coupled with a current limiting resistor R9. The transistor Q3 amplifies the pulsed output signal from line (pin 8) to alternately drive the transformer from high VCC to ground and vice versa, with the transformed pulse driving a ceramic transducer to generate an audible alarm. It should be noted that a software routine within the microprocessor generates this pulsed output, which is amplified by the transistor Q3. In addition to the generation of an audible alarm (which may be emanated through grill 132), as further illustrated, other output periphery devices may include the use of a visual indicator D1 that use LEDs 130 to notify users of an occurrence. The visual indicator D1 is coupled with line pin 9 of the microprocessor 826. As indicated above, other output periphery devices not illustrated may also easily be accommodated and connected with the microprocessor 826.

As further illustrated, pins 1 and 14 of the microprocessor 826 are coupled to VCC and ground via a filter capacitor C4, which power the microprocessor 826. The microprocessor 826 is further coupled via its pin 2 to ground through another filter capacitor C3. The crystal X1 coupled to pin 13 is used to facilitate a clocking signal to the microprocessor 826. That is, it stabilizes the frequency of the clock in the microprocessor 826. Pins 10 and 11 are respectively for reset and test of the microprocessor 826, which is through a connector CON 3 that enables the testing and reset of the microprocessor 826. The testing and reset enable determination of signaling of the microprocessor 826, for example, to determine if the microprocessor 826 functions based on "0" or "1" input signal level to trigger a device. In this exemplary instance, the microprocessor 826 will trigger an output periphery device when the input is pulled to high (or "1"). For example, when the adjustable piece 108 is cut, the switch S2 is opened, pulling the line 858 to Vcc (high or "1"), which triggers an alarm. The reset pin 10 is coupled with the reset circuit 832, which includes a current limiting resistor R7 that is coupled at one end to Vcc and other end to a capacitor C5, with the other end of the capacitor C5 coupled to ground. The reset pin 10 is coupled with at the junction of the resistor R7 and capacitor C5.

Figure 9:
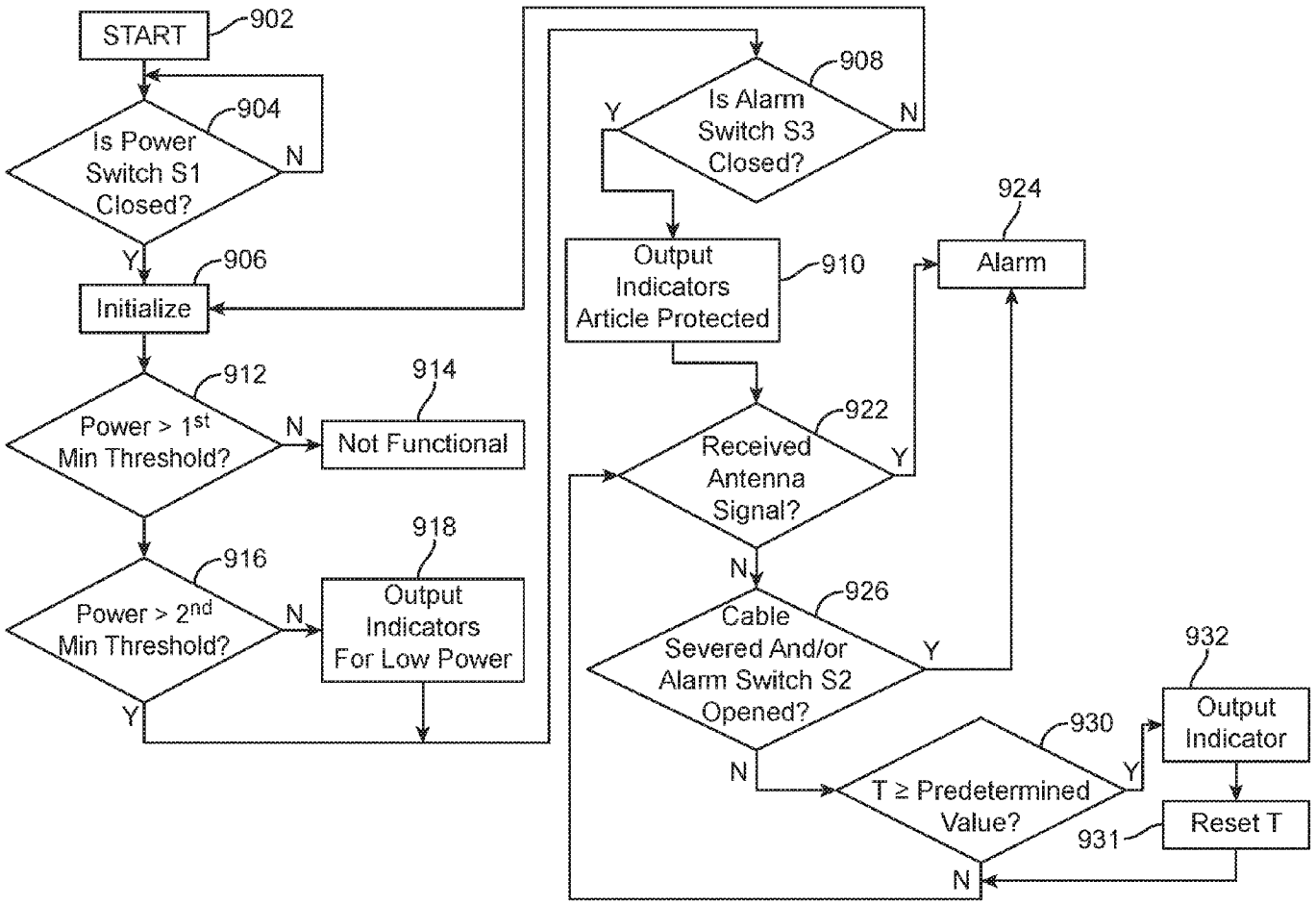
FIG. 9 is a non-limiting exemplary flowchart, which illustrates the power management and functionality of a microprocessor used in the EAS theft deterrent tag of FIGS. 1A to 8C in accordance with the present invention.

FIG. 9 is an exemplary flowchart, which illustrates the power management and functionality of the microprocessor 826 for the EAS tag 100. As illustrated, upon start of the program at the operational functional act 902, the microprocessor 826 at the next operational functional act 904 determines if the power plunger switch S1 is closed. If the microprocessor 826 determines that the power plunger S1 is closed, then it initializes at the operational functional act 906, and at the operational functional act 912 the microprocessor 826 determiners if supplied power is greater than a first threshold level. If at the operational functional act 912 it is determined that supplied power is not greater than a first threshold level, the device is non-functional (operational functional act 914). Otherwise, if at the operational act 912 the microprocessor 826 determines that supplied power is greater than the first threshold, the microprocessor 826, at the operational functional act 916, determines if the supplied power is greater than a second threshold level, with the second threshold level greater than the first threshold level. If the microprocessor 826 determines that the supplied power is not greater than a second threshold level, the microprocessor 826 at the operational act 918 activates various output periphery units in certain manner to indicate low supply of power, but continues and activates the alarm to protect an article. If the microprocessor 826 determines that the supplied power is greater than the second threshold level, the microprocessor 826 at the operational functional act 908 determines if the alarm switch S3 is closed. If so, the alarm is set (or armed), and various indicators are activated to indicate to user that the article is protected (operational functional act 910). If the switch S3 is not closed, then initialization process 906 is repeated.

To continue with the flowchart of FIG. 9, the microprocessor 826 at the operational act 922 determines if an antenna signal is received from any one of one or more transponders 502*a* to 502N. If the microprocessor 826 determines that such an antenna signal is received, at the operational act 924 the microprocessor 826 activates (or triggers) and sounds an alarm. A non-limiting example for such an alarm incident (or condition) is the actual removal of the article to which the EAS tag 100 is connected from a store, passing them through a surveillance zone. This will activate at least one of the one or more transponders 502*a* to 502N to trigger a signal, which will be amplified (via the amplifier 801) and input to the microprocessor 826 to activate (or trigger the alarm). If the microprocessor 826 determines that no such antenna signal was received, the microprocessor 826, at the operational functional act 926 determines if the adjustable piece 108 has been cut or the alarm plunger switch S3 is open. If the microprocessor 826 determines that the cable is cut and/or the alarm plunger switch S3 is open, at the operational act 924 the microprocessor 826 activates (or triggers) the alarm, which indicates an actual tampering of the EAS tag 100. On the other hand, if the microprocessor 826 determines that the adjustable piece 108 is not cut and the alarm plunger switch S3 is still closed, at functional act 930 a determination is made regarding a timer to determine if a predetermined time has been reached. If at operational functional act 930 it is determined that a predetermined time has elapsed, an indicator is output and the timer is reset at operational functional act 931, where the microprocessor 826 then repeats operational functional act 912. The output indicator 932 is an audio and or visual indicator that enables a user to determine if the tag 100 is properly armed. The microprocessor 826 output a visual and or audio indicator periodically (while the EAS tag 100 is armed) at specified predetermined time intervals T.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the EAS tag 100 illustrated would be fully functional without the adjustable piece 108 and/or the second member 106. That is, the theft-deterrent tag 100 may only comprise the main member 104 with the article secured with the gap 110. Alternatively, the EAS tag 100 may only comprise the main member 104 and the adjustable piece 108 as described above. As still another example, the microprocessor 826 and the circuit topography illustrated in FIG. 8A may be designed so that the output of the various modules pulled high and set to "1" instruct the microprocessor 826 to arm the alarm. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A theft-deterrent tag, comprising:

a main member coupled with an article and an adjustable piece that is looped around the article and manipulated for a tight engagement of the main member with the article, wherein the main member defines a gap for securing a portion of the article therein, while the adjustable piece is wrapped around the article, and the main member includes:

a main first part that contacts a first article side of the portion of the article;

a main second part that contacts a second article side of the portion of the article; and a main third part that connects the first and the second parts and contacts a third article side of the portion of the article.

2. The theft-deterrent tag as set forth in claim 1, wherein:

the main first part of the main member accommodates a reel mechanism;

the main second part of the main member accommodates a power source and electronics of an Electronic Article Surveillance (EAS) system;

the main third part of the main member accommodates an alarm switch that actuates upon securing the article within the gap.

3. The theft-deterrent tag as set forth in claim 2, wherein:

the alarm switch is actuated when a side of the article is pressed against the alarm switch, and the theft-deterrent tag is tightly secured on the article.

4. The theft-deterrent tag as set forth in claim 3, wherein:
the adjustable piece is comprised of a multi-wire lanyard having:
a first end and a second end coupled with the respective main first and second parts of the main member, and a lanyard body that forms a loop.

5. The theft-deterrent tag as set forth in claim 4, wherein:
the first end of the lanyard extends out of the main first part of the main member with the body of the lanyard looped and entering into the main second part of the main member, with the second end of the lanyard coupled with the main second part of the main member.

6. The theft-deterrent tag as set forth in claim 5, wherein:
the first end of the lanyard is coupled with the reel mechanism;
the second end of the lanyard is coupled with the housed electronics; and the lanyard body is looped and lassoed around the article.

7. The theft-deterrent tag as set forth in claim 6, wherein:
the main member is tightly secured with the article when the adjustable piece is contracted.

8. The theft-deterrent tag as set forth in claim 7, wherein:
the main first, second, and third parts of the main member are movably adjustable in relation to one another for varying a size of the main gap.

9. A theft-deterrent tag, comprising:
a first member coupled with a first article portion of an article and a second member coupled with a second article portion of the article, with the first member associated with the second member by an adjustable piece; wherein
both the first member and the second member include:
a first part that contacts a first article side of the respective first article portion and the second article portion;
a second part that contacts a second article side of the respective first article portion and the second article portion; and
a third part that connects the first and the second parts and contacts a third article side of the respective first article portion and the second article portion.

10. The theft-deterrent tag as set forth in claim 9, wherein:
the first and second article portions are positioned separately from each other.

11. The theft-deterrent tag as set forth in claim 10, wherein:
the first member, the second member, and the adjustable piece are separate and independent, forming separate and independent elements.

12. The theft-deterrent tag as set forth in claim 11, wherein:
the first member defines a first gap for securing the first article portion therein, and the second member defines a second gap for securing the second article portion therein, with the adjustable piece coupled with the first and second member is manipulated for a tight engagement of the first and second members with the article.

13. The theft-deterrent tag as set forth in claim 12, wherein:
the first part of the first member accommodates a reel mechanism;
the second part of the first member accommodates a power source and electronics of the theft-deterrent tag, constituting an Electronic Article Surveillance (EAS) tag;
the third part of the first member accommodates an alarm switch that actuates upon securing the article within the first gap.

14. The theft-deterrent tag as set forth in claim 13, wherein:
the alarm switch is actuated when a side of the article is pressed against the alarm switch, and the theft-deterrent tag is tightly secured on the article.

15. The theft-deterrent tag as set forth in claim 14, wherein:
the alarm switch is comprised of a substantially T-shaped configuration that includes:
a handle section and a head section;
a lower end of the handle section is comprised of a pivot arm that ends in a pivot aperture that accommodates a pivot shaft, enabling the alarm switch to pivot along a reciprocating path substantially parallel to the longitudinal axis of the first member to one of actuated and non-actuated positions;
the head section includes:
an engaging portion that contacts with the article;
a rear beveled engaging portion that closes an alarm plunger switch when the alarm switch is actuated; and
a biasing surface that couples the handle section and maintains the alarm switch to a non-actuated position by a contacting biasing mechanism.

16. The theft-deterrent tag as set forth in claim 14, wherein:
a clutch housing that accommodates a clutch is brought near a magnet where the clutch is pulled out of a clutch interlock aperture, the power switch is pressed in slightly and then is released to an open position for powering OFF and deactivating an alarm.

17. The theft-deterrent tag as set forth in claim 13, wherein:
the reel mechanism is accommodated within a through-hole, transverse the longitudinal axis of the first part of the first member;
the reel mechanism is comprised of:
a revolving spool with a handle;
the spool is comprised of a first flange, a second flange, and a spool body, with the first flange having a wider span than the second flange;
the first flange has a periphery that includes a wall that is serrated along an exterior facing side; and
the spool body in between the first and second flange accommodates a majority portion of the adjusting piece, and includes an opening for insertion and interlocking of a first end of the adjustable piece at a substantial center of the spool body.

18. The theft-deterrent tag as set forth in claim 9, wherein:
the first, second, and third part of the second member guide the adjustable piece looped back towards the first member.

19. The theft-deterrent tag as set forth in claim 9, wherein:
the adjustable piece is comprised of a multi-wire lanyard having:
a first end and a second end coupled with the first member, and a lanyard body that loops through the second member.

20. The theft-deterrent tag as set forth in claim 19, wherein:
the first end of the lanyard extends out of the first part of the first member with the body of the lanyard entering a first part of the second member, looping through the second member and exiting a second part of the second member and into the second part of the first member, with the second end of the lanyard coupled with the second part of the first member.

21. The theft-deterrent tag as set forth in claim 20, wherein:

the first end of the lanyard is coupled with a reel mechanism;

the second end of the lanyard is coupled with an alarm system; and the lanyard body is accommodated by the second member, and is looped there-through over a roller mechanism to facilitate ease of adjustability of the adjustable piece to one of an extended and a contracted position.

22. The theft-deterrent tag as set forth in claim 9, wherein:

the first and second members may be maneuvered in opposite directions, which extends the adjustable piece, and the first and second members are maneuvered towards each other when the adjustable piece is contracted.

23. The theft-deterrent tag as set forth in claim 9, wherein:

the second member is comprised of:

a first opening in a top front area of a first part of the second member; and a second opening in a bottom front area of a second part of the second member;

and an interior of the second member includes:

a cavity that enables free maneuverability of the adjustable piece; and a roller housing that accommodates a roller.

24. The theft-deterrent tag as set forth in claim 9, wherein:

a power switch is moved along a reciprocating path, transverse a longitudinal axis of the first member to actuate a power plunger switch to enable supply of power to an internal alarm system of the theft-deterrent tag;

the power switch is biased, extending out of a lateral rear side of the first member when the power switch is in open position by a biasing mechanism;

the biasing mechanism includes a clutch interlock aperture for detachably interlocking with a clutch when the power switch is in closed position;

the power switch includes a beveled side that engages an intermediate member, which in turn, releases a plunger of the power plunger switch when the power switch reaches a closed position.

25. The theft-deterrent tag as set forth in claim 24, wherein:

the intermediate member further includes a lateral flange that is extended substantially perpendicular to an axial length of the intermediate member with a flange surface that contacts a plunger of the power plunger switch at a first position, and a second end of the intermediate member is beveled and engages with the beveled side of the power switch.

26. The theft-deterrent tag as set forth in claim 25, wherein:

the intermediate member actuates an interlocking member and a biasing scheme, both of which are accommodated by the intermediate member, with the interlocking member including beveled serrations at a first end thereof, which are oriented at a first direction that interlock with beveled serrations of a spool of a reel mechanism that are oriented at a second, opposite direction;

the spool, and the interlock member and biasing scheme form a ratchet and pawl mechanism, with the beveled serrations of the pawl forming a first set of sloped teeth, and the beveled serrations of the spool forming a second set of oppositely oriented sloped teeth;

whereby when the spool teeth are moving in a first direction, the pawl teeth slide up and over a gently sloped edges of the spool teeth, with biasing mechanism in a form of a spring forcing the pawl teeth into the depression between the spool teeth as the pawl teeth pass the tip of each spool tooth;

whereby when the spool teeth move in a second, opposite direction, the pawl teeth catch against steeply sloped edge of a first tooth of the spool teeth that the pawl teeth encounter, thereby locking the spool against the pawl tooth and preventing any further motion of the spool in the second direction.

27. The theft-deterrent tag as set forth in claim 9, wherein:

the adjustable piece is a two-wire lanyard forming a sense loop cable, having:

inner conductors enclosed within outer conductors;

the inner conductors longitudinally insulated from one another and from the outer conductors by inner dielectric layers, with an outermost outer conductor of the outer conductors longitudinally insulated by an outer dielectric layer;

a first distal end of the cable is comprised of a first end of the inner and outer conductors that are permanently connected together, and a second distal end of the cable is comprised of a second end of the inner and outer conductors.

28. The theft-deterrent tag as set forth in claim 27, wherein:

at least one conductor of the conductors is an internal spirally-wrapped electrical conductive cord for added mechanical strength.

29. A method for securing an article with a theft deterrent tag, comprising:

inserting a first article portion of the article within a first gap of a first piece of the theft deterrent tag;

inserting a second article portion of the article within a second gap of a second piece of the theft deterrent tag;

manipulating the first and second pieces by an adjustable piece of the theft-deterrent tag for a tight engagement of the theft deterrent tag with the article, thereby actuating an alarm switch for setting an alarm system; and actuating a power switch to supply power to the alarm system of the theft deterrent tag.

30. The method for securing an article as set forth in claim 29, wherein:

the alarm switch is actuated by the article when the article is positioned and tightly secured within the first and second gaps when the first and second pieces are maneuvered towards each other by the adjustable piece.

31. The method for securing an article as set forth in claim 29, wherein:

the alarm switch is actuated by a side of the first article portion of the article.

* * * * *